US010543150B2

(12) United States Patent
Noguchi et al.

(10) Patent No.: US 10,543,150 B2
(45) Date of Patent: Jan. 28, 2020

(54) VIAL SHIELD

(71) Applicant: JMS CO., LTD., Hiroshima-shi, Hiroshima (JP)

(72) Inventors: Yusuke Noguchi, Hiroshima (JP); Masahiko Takeuchi, Hiroshima (JP)

(73) Assignee: JMS Co., Ltd., Hiroshima (JP)

( * ) Notice: Subject to any disclaimer, the term of this patent is extended or adjusted under 35 U.S.C. 154(b) by 263 days.

(21) Appl. No.: 14/655,567

(22) PCT Filed: Dec. 24, 2013

(86) PCT No.: PCT/JP2013/084510
§ 371 (c)(1),
(2) Date: Jun. 25, 2015

(87) PCT Pub. No.: WO2014/104027
PCT Pub. Date: Jul. 3, 2014

(65) Prior Publication Data

US 2015/0366758 A1 Dec. 24, 2015

(30) Foreign Application Priority Data

Dec. 28, 2012 (JP) ..... 2012-287526

(51) Int. Cl.
*A61J 1/20* (2006.01)
*A61J 1/14* (2006.01)

(52) U.S. Cl.
CPC ..... *A61J 1/2044* (2015.05); *A61J 1/1425* (2015.05)

(58) Field of Classification Search
CPC ..... A61J 1/1406; A61J 1/2044; A61J 1/1412; A61J 1/2048
See application file for complete search history.

(56) References Cited

U.S. PATENT DOCUMENTS

| | | | |
|---|---|---|---|
| 4,582,207 | A | 4/1986 | Howard et al. |
| 4,768,568 | A | 9/1988 | Fournier et al. |
| 4,982,769 | A | 1/1991 | Fournier et al. |
| 6,022,339 | A | 2/2000 | Fowles |

(Continued)

FOREIGN PATENT DOCUMENTS

| | | |
|---|---|---|
| FR | 2 967 655 | 5/2012 |
| JP | 61-502170 | 10/1986 |

(Continued)

OTHER PUBLICATIONS

Extended European Search Report issued in corresponding European Application, dated Jun. 27, 2016, 7 pages.

*Primary Examiner* — Leslie R Deak
(74) *Attorney, Agent, or Firm* — Hamre, Schumann, Mueller & Larson, P.C.

(57) ABSTRACT

A vial shield (1) has a shield main body (10) and a valve element (20). The shield main body (10) includes an annular top plate (11) that is to be laid on top of an upper surface of a stopper (86) that seals a mouth (83) of the vial bottle (80), a plurality of legs (15) extending downward from the top plate (11), and a plurality of claws (16) provided in the plurality of legs (15), the claws being engageable with the mouth (83) of the vial bottle (80). The valve element (20) blocks an opening at the center (12) of the top plate (11). A cut (22) passing through the valve element (20) in a vertical direction is formed in the valve element (20).

15 Claims, 22 Drawing Sheets

(56) References Cited

U.S. PATENT DOCUMENTS

| | | | | |
|---|---|---|---|---|
| 7,845,505 | B2 | 12/2010 | Hamamoto et al. | |
| 9,339,438 | B2 * | 5/2016 | Lev | A61J 1/2089 |
| 2011/0175347 | A1 | 7/2011 | Okiyama | |
| 2011/0178493 | A1 | 7/2011 | Okiyama | |
| 2013/0240476 | A1 | 9/2013 | Aneas | |

FOREIGN PATENT DOCUMENTS

| | | | |
|---|---|---|---|
| JP | 5-088142 | B | 12/1993 |
| JP | 6-038835 | B | 5/1994 |
| JP | 2003-334234 | | 11/2003 |
| JP | 2005-073758 | | 3/2005 |
| JP | 4526480 | B | 8/2010 |
| WO | 85/04801 | | 11/1985 |
| WO | 2010/061742 | | 6/2010 |
| WO | 2010/061743 | | 6/2010 |

* cited by examiner

VIAL SHIELD

TECHNICAL FIELD

The present invention relates to a vial shield that is to be put over a stopper of a vial bottle.

BACKGROUND ART

Drugs in powder form are generally distributed in vial bottles in which the drugs are sealed in a gas-tight manner. To administer such a drug to a patient, a solvent is injected into the vial bottle, the drug is dissolved in the solvent to obtain a drug solution, and then the drug solution is transferred from the vial bottle into a drug solution bag. After that, the drug solution within the drug solution bag is administered to the patient. The injection of the solvent into the vial bottle and the extraction of the drug solution from the vial bottle are performed by piercing a stopper (rubber stopper) that seals a mouth (opening) of the vial bottle with a piercing needle (sometimes referred to as "bottle needle").

There are cases where the drug contained in the vial bottle is a drug that is designated as a powerful drug like an anticancer agent, for example. Adhesion of such hazardous drugs and their drug solutions to the finger or the like of an operator and inhalation of such drugs and their vapor by the operator must be avoided. Thus, a connector is known which enables a series of operations from the transfer of the solvent within the drug solution bag into the vial bottle to the transfer of the drug solution within the vial bottle into the drug solution bag to be performed while the connector remains connected to the vial bottle and the drug solution bag (see Patent Documents 1 and 2, for example). This connector does not need to be repeatedly connected to and disconnected from the vial bottle and the drug solution bag in the process by which the prepared drug solution is obtained within drug solution bag. Therefore, the possibility that the drugs and the drug solutions may escape to the outside environment is generally low.

CITATION LIST

Patent Document

Patent Document 1: WO 2010/061742
Patent Document 2: WO 2010/061743

DISCLOSURE OF INVENTION

Problem to be Solved by the Invention

The above-described conventional connector includes a piercing needle with which the stopper of the vial bottle is to be pierced for the purpose of connection to the vial bottle.

In the case where a positive pressure is created within the vial bottle because of the volatility of the drug, for example, when the stopper is pierced with the piercing needle, the drug within the vial bottle may escape to the outside environment through a gap between the stopper and the piercing needle. Also, when the piercing needle is withdrawn from the stopper after the drug solution is extracted from the vial bottle, the drug solution may adhere to an outer surface of the withdrawn piercing needle and a region of the stopper around the hole that is made in the stopper by the piercing needle.

Accordingly, even when the above-described connector is used, it is difficult to completely prevent the escape of the drug and the drug solution to the outside environment.

It is an object of the present invention to reduce escape of a drug and a drug solution within a vial bottle to the outside environment which may be caused by piercing a stopper of the vial bottle with a piercing needle and withdrawal of the piercing needle from the stopper.

Means for Solving Problem

A vial shield according to the present invention is configured to be attached to a vial bottle so as to cover at least a portion of a stopper that seals a mouth of the vial bottle. The vial shield has a shield main body including an annular top plate that is to be laid on top of an upper surface of the stopper, a plurality of legs extending downward from the top plate, and a plurality of claws provided in the plurality of legs, the claws being engageable with the mouth of the vial bottle, as well as a valve element that blocks an opening at the center of the top plate. A cut passing through the valve element in a vertical direction is formed in the valve element.

Effects of the Invention

Attaching the vial shield of the present invention to the vial bottle makes it possible to reduce escape of a drug and a drug solution within the vial bottle to the outside environment which may be caused by piercing the stopper of the vial bottle with the piercing needle and withdrawal of the piercing needle from the stopper.

DESCRIPTION OF THE INVENTION

Figure 1A:
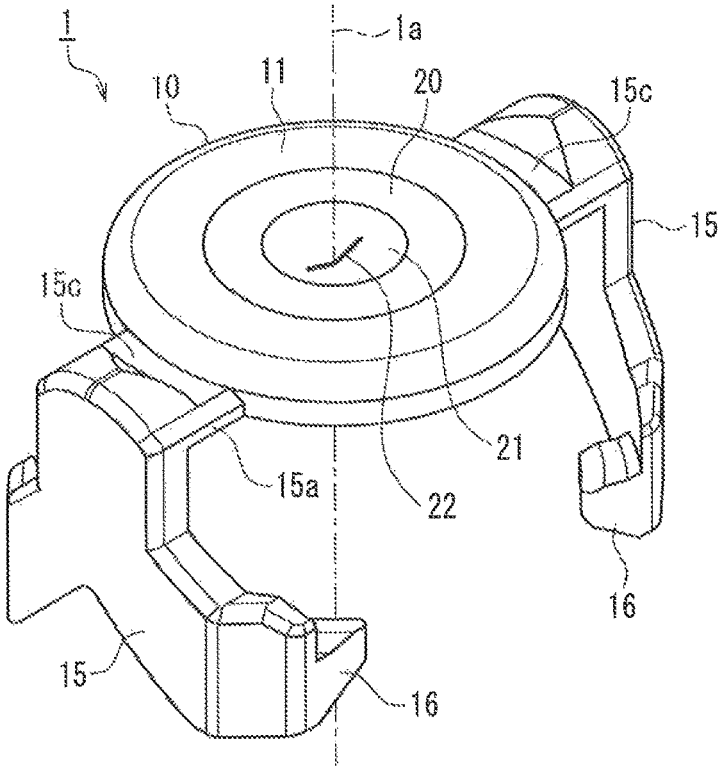
FIG. 1A is a perspective view of a vial shield according to Embodiment 1 of the present invention when viewed from above.

In the above-described vial shield of the present invention, it is also possible that the top plate is connected to the plurality of legs via a plurality of bridge portions so that the top plate can be displaced upward relative to the plurality of legs. With this configuration, variations in vertical dimensions of the stopper and a flange of the vial bottle are accommodated by the top plate being displaced upward. Accordingly, an allowable dimensional range of the vial bottle to which the vial shield can be attached is expanded.

It is also possible that at least one protrusion is formed on a surface of the valve element that is located on a side opposing the stopper. With this configuration, variations in vertical dimensions of the stopper and the flange of the vial bottle are accommodated by the at least one protrusion changing the amount of compressive deformation. Accordingly, the allowable dimensional range of the vial bottle to which the vial shield can be attached is expanded.

In the above-described vial shield, it is also possible that the at least one protrusion includes a rib extending continuously annularly so as to surround the cut. With this configuration, a sealed space is formed between the valve element and the stopper, and thus the possibility of escape of a drug and a drug solution to the outside environment can be further reduced. Moreover, during insertion of the piercing needle into the cut of the valve element, the valve element is deformed into a depressed shape such that the cut is located at the deepest portion, and thus the piercing needle can be properly guided to the cut of the valve element.

It is also possible that a cap is attached to the stopper and the mouth so as to prevent the stopper from coming off the mouth of the vial bottle. In this case, it is preferable that the at least one protrusion is provided at a position where the protrusion abuts against the cap. Thus, the capacity of the space between the valve element and the stopper is increased. This is advantageous in reducing the escape of the drug and the drug solution and guiding the piercing needle to the cut. Moreover, since the at least one protrusion abuts against the relatively hard cap, the sealability of the space between the valve element and the stopper is improved. This also is advantageous in reducing the escape of the drug and the drug solution.

It is also possible that the at least one protrusion includes a central protrusion. In this case, it is preferable that the cut is formed within the central protrusion. Thus, when a pressing force is applied to the valve element by the piercing needle, the central protrusion suppresses the compression of the space between the valve element and the stopper. This is advantageous in reducing the escape of the drug and the drug solution kept in that space to the outside environment. Moreover, providing the central protrusion in the valve element increases the thickness of a portion of the valve element that is in the vicinity of the cut. This is advantageous in improving the sealability of the cut.

It is preferable that the central protrusion is provided at a position where the central protrusion abuts against the stopper. With this configuration, the central protrusion can be brought into close contact with the stopper. This is advantageous in suppressing escape of the drug and the drug solution within the vial bottle to the side of the valve element through a gap between the piercing needle and the stopper.

In the above-described vial shield according to the present invention, it is preferable that when the vial shield is attached to the vial bottle, a sealed space is formed between the valve element and the stopper and in a region that contains the cut of the valve element. With this configuration, the drug and the drug solution escaping through a puncture hole that is made in the valve element by the piercing needle is kept in the sealed space. This is advantageous in suppressing the escape of the drug and the drug solution to the outside environment.

In the above-described vial shield according to the present invention, it is also possible that a recess is formed in a surface of the valve element that is located on a side opposite to the stopper. In this case, it is preferable that the cut is formed within the recess. With this configuration, during insertion of the piercing needle into the cut of the valve element, the recess properly guides the piercing needle to the cut of the valve element. Accordingly, the possibility that the piercing needle may pierce a portion of the valve element other than the cut is reduced.

In the above-described vial shield according to the present invention, it is also possible that each of the plurality of claws has, on a side opposing the top plate, a surface that is sloped in such a manner as to approach the top plate toward a leading end of the claw. With this configuration, even when the stopper or the flange of the vial bottle has a large outer diameter, reliable engagement of the claws with the flange can be secured.

In the above-described vial shield according to the present invention, it is also possible that a cap is attached to the stopper and the mouth so as to prevent the stopper from coming off the mouth of the vial bottle. In this case, it is preferable that the plurality of claws are configured to engage with a lower end of the cap. This is advantageous in more securely attaching the vial shield to the vial bottle.

It is also possible that the above-described vial shield according to the present invention further includes a substantially undisplaceable member that surrounds, via a slit, a portion of the leg in which the claw is formed. This configuration makes it difficult for an operator to release the engagement of the claws with the mouth of the vial bottle by putting the fingers on the legs. Accordingly, this is advantageous in reducing the possibility that an erroneous operation of releasing the drug and the drug solution kept in the space between the valve element and the stopper to the outside environment may be performed by erroneously detaching the vial shield from the vial bottle.

In the above-described vial shield according to the present invention, it is also possible that a thin portion is provided in the plurality of bridge portions that connect the top plate to the plurality of legs, the plurality of legs, or the top plate. In this case, it is preferable that the thin portion is configured to reduce deformation of a portion of the top plate that holds the valve element, when the plurality of legs are elastically displaced. This is advantageous in reducing the possibility of separation of the valve element from the top plate. Moreover, this is advantageous in securing the sealability of the space between the valve element and the stopper irrespective of the outer diameter of the cap (or the outer diameters of the stopper and the flange).

In the above-described vial shield according to the present invention, it is also possible that the number of the plurality of claws is three or more. With this configuration, the vial shield can be stably and reliably attached to the vial bottle.

Hereinafter, the present invention will be described in detail while showing preferred embodiments thereof. However, it goes without saying that the present invention is not limited to the embodiments below. In the drawings that will be referred to in the following description, only main members of constituent members of the embodiments of the present invention that are necessary for the description of the present invention are shown in a simplified manner for the sake of convenience of description. Accordingly, the present invention may include optional members that are not shown in the drawings below. Moreover, it should be understood that the dimensions of the members in the drawings below are not faithful representation of the dimensions of actual members, dimensional ratios of those members, and the like.

Embodiment 1

Configuration of Vial Shield

Figure 1B:
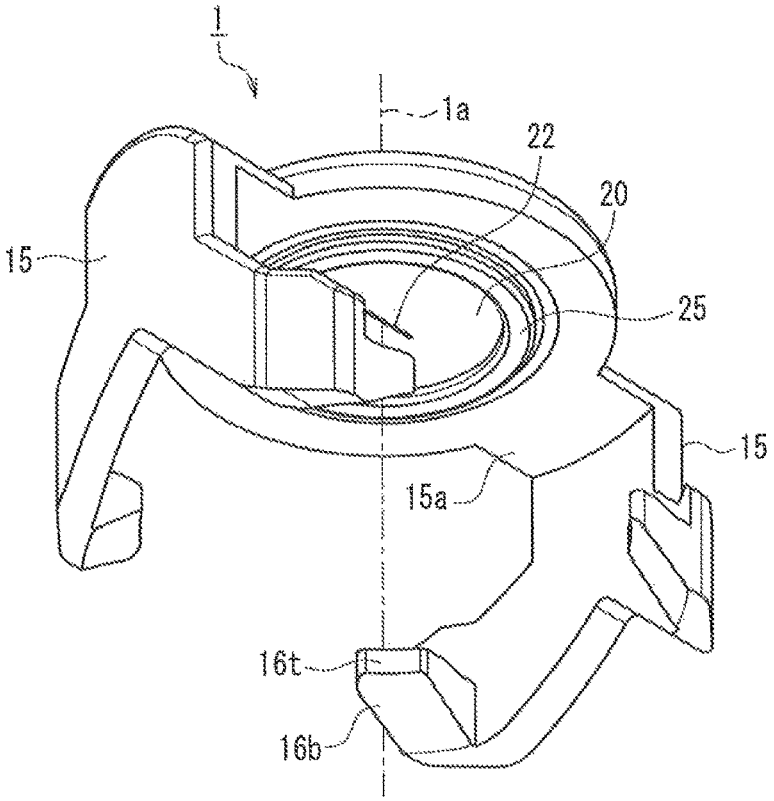
FIG. 1B is a perspective view of the vial shield according to Embodiment 1 of the present invention when viewed from below.
Figure 2A:
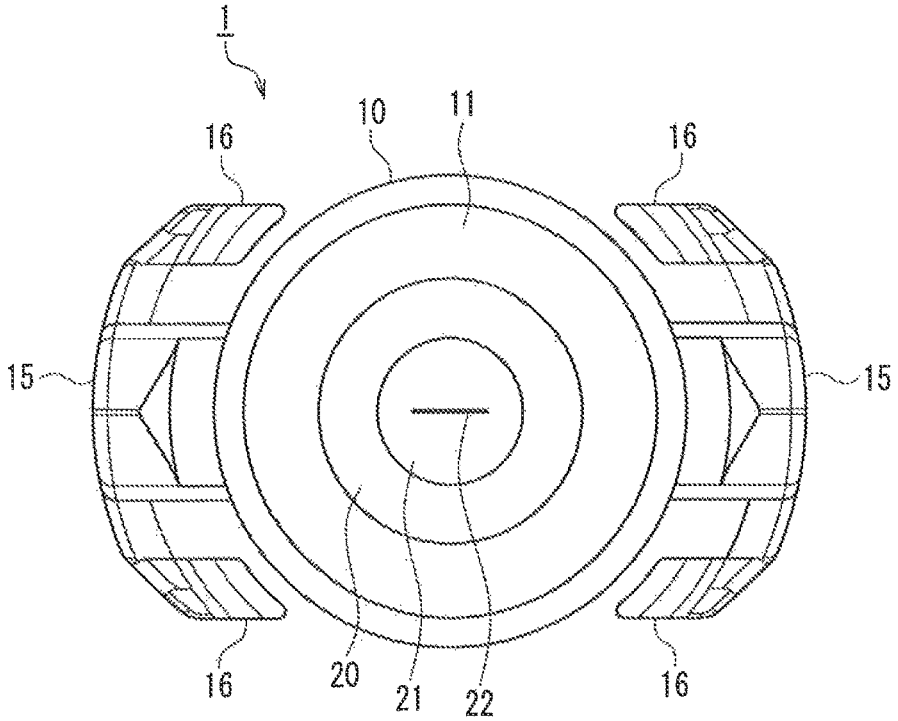
FIG. 2A is a plan view of the vial shield according to Embodiment 1 of the present invention.
Figure 2B:
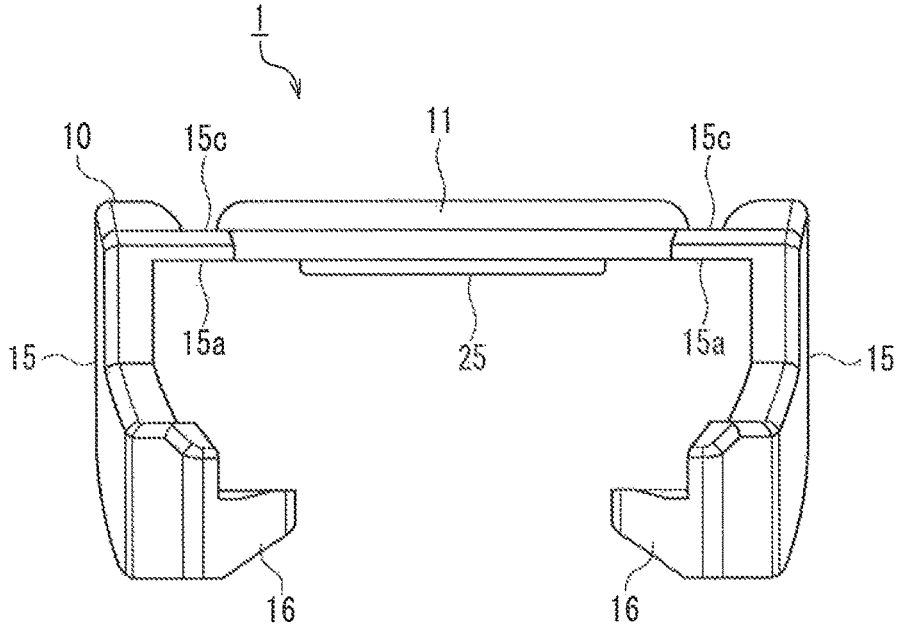
FIG. 2B is a side view of the vial shield according to an embodiment of the present invention.
Figure 3:
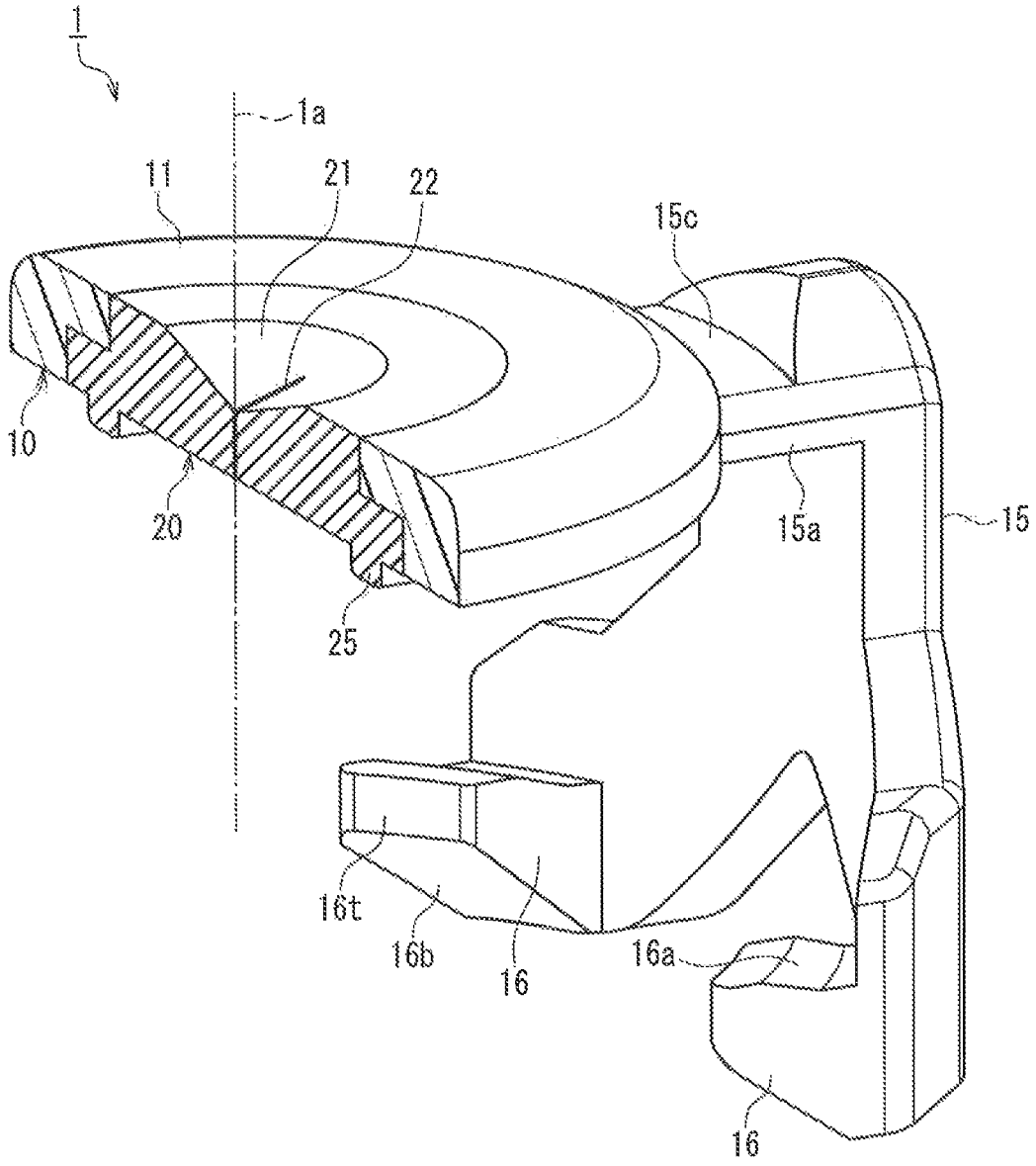
FIG. 3 is a cross-sectional perspective view of the vial shield according to Embodiment 1 of the present invention.
Figure 4:
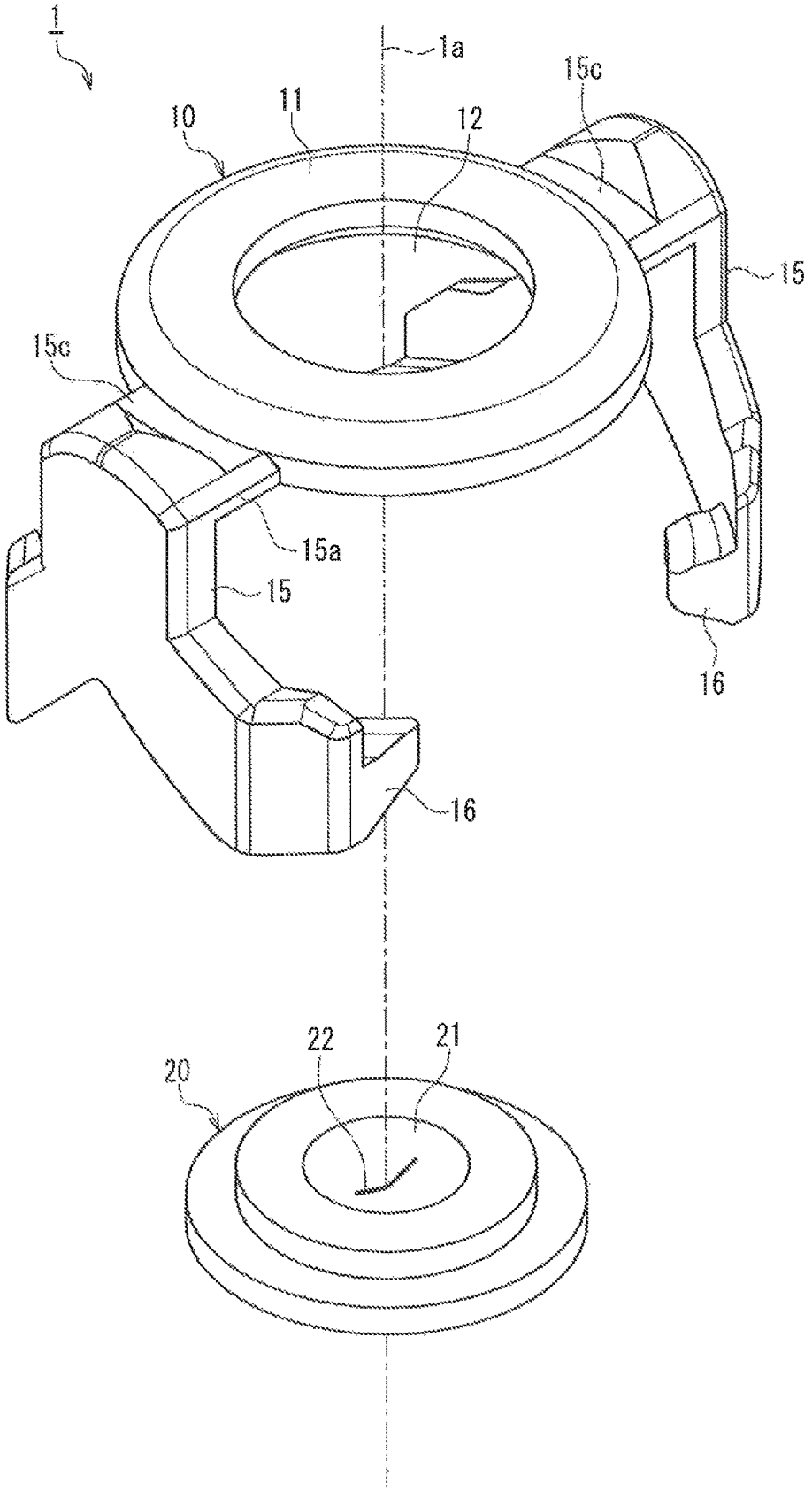
FIG. 4 is an exploded perspective view of the vial shield according to Embodiment 1 of the present invention.

FIG. 1A is a perspective view of a vial shield 1 according to Embodiment 1 of the present invention when viewed from above, and FIG. 1B is a perspective view of the vial shield 1 when viewed from below. FIG. 2A is a plan view of the vial shield 1, and FIG. 2B is a side view of the vial shield 1. FIG. 3 is a cross-sectional perspective view of the vial shield 1 taken along a plane containing a central axis 1*a* of the vial shield 1. FIG. 4 is an exploded perspective view of the vial shield 1. For the sake of convenience of the following description, a direction that is parallel to the central axis 1*a* of the vial shield 1 is referred to as "vertical direction", the upper side of the paper plane in FIG. 2B is referred to as "upper side" of the vial shield 1, and the lower side of the paper plane in FIG. 2B is referred to as "lower side" of the vial shield 1. A direction that is parallel to a plane perpendicular to the central axis 1*a* is referred to as "horizontal direction". A direction of rotation around the central axis 1*a* is referred to as "circumferential direction", and a direction that is orthogonal to the central axis 1*a* is referred to as "radial direction". However, the above-described "upper side", "lower side", and "horizontal direction" do not mean the attitude (orientation) of the vial shield 1 during actual use.

As shown in FIG. 4, the vial shield 1 is constituted by a shield main body 10 and a valve element 20.

The shield main body 10 includes a top plate 11 with an opening 12 formed at its center, and a pair of legs 15 extending downward from the top plate 11.

The top plate 11 is a ring-shaped object whose outer edge and inner edge have concentric circular shapes in a plan view, the inner edge defining the opening 12. However, the shape of the top plate 11 is not limited to this. For example, the outer edge of the top plate 11 in a plan view may also have any shape such as an elliptic shape, a rhombic shape, or the like.

A pair of horizontal portions (bridge portions) 15*a* extend substantially in the radial direction from an outer peripheral edge of the top plate 11. The legs 15 extend downward substantially parallel to the central axis 1*a* from respective outer ends (ends on the sides opposite to the top plate 11) of the horizontal portions 15*a*. The pair of horizontal portions 15*a* and the pair of legs 15 are arranged at symmetrical positions with respect to the central axis 1*a*. Each leg 15 is substantially "Y"-shaped with a lower portion of the leg 15 being bifurcated in the circumferential direction. A claw 16 is formed at each of the two distal ends into which the leg 15 is bifurcated, the claw 16 protruding toward the central axis 1*a*. A surface (upper surface) 16*a* (see FIG. 3) of the claw 16 that opposes the top plate 11 is sloped in such a manner as to approach the top plate 11 toward a leading end 16*t* (portion of the claw 16 that is closest to the central axis 1*a*) of the claw 16. Moreover, a surface (lower surface) 16*b* (see FIG. 3) of the claw 16 that is located on a side opposite to the top plate 11 is also sloped in such a manner as to approach the top plate 11 toward the leading end 16*t* of the claw 16.

A groove extending across the horizontal portion 15*a* in the circumferential direction is formed in an upper surface of the horizontal portion 15*a*. As a result, that portion of the horizontal portion 15*a* in which the groove is formed constitutes a thin portion 15*c* having a relatively small thickness when compared with the other portions. It should be noted that it is also possible that the groove is formed in a lower surface of the horizontal portion 15*a*.

The legs 15 can be elastically displaced in a direction (outward) in which the claws 16 move away from the central axis 1*a*. The rigidity (mechanical strength) of the shield main body 10 is minimal at the thin portions 15*c*, and therefore, when the legs 15 are elastically displaced as described above, mainly the thin portions 15*c* of the respective horizontal portions 15*a* are elastically bent.

The shield main body 10 is made of a hard material. Specific examples thereof may include, but not particularly limited to, polyethylene, polypropylene, polycarbonate, styrene-ethylene, polyethylene terephthalate, polybutylene terephthalate, butylene-styrene block copolymer, and the like. Polyolefin resins such as polyethylene and polypropylene are preferable considering that the shield main body 10 is used in medical applications and the legs 15 are elastically displaced. The shield main body 10 can be integrally formed by injection molding a resin material such as those described above.

As shown in FIG. 4, the valve element 20 is a thin plate-shaped object having a circular shape in a plan view. The valve element 20 is made of a rubber-like elastic material that is deformed by application of an external force and that immediately returns to its initial shape upon removal of the external force. Preferably, the elastic material has a JIS-A hardness of 20 to 55. Specifically, rubber such as natural rubber, isoprene rubber, silicone rubber, and the like as well as thermoplastic elastomers such as styrene elastomers, olefin elastomers, polyurethane elastomers, and the like can be used.

As shown in FIG. 3, a recess 21 for reducing the thickness of the valve element 20 is formed at the center of an upper surface of the valve element 20. Moreover, a cut 22 passing through the valve element 20 in a thickness direction (vertical direction) is formed within the recess 21. Although the shape of the recess 21 is not particularly limited, it is preferable that the recess 21 has a surface that is sloped down toward the cut 22, such as a conical surface, a truncated conical surface (a shape obtained by cutting off a portion of a conical surface including the top thereof along a plane that is parallel to the base), a spherical surface, or the like. As shown in FIGS. 1B and 3, a rib (protrusion) 25 is formed on a lower surface of the valve element 20, protruding downward so as to have a fixed height. The rib 25 extends continuously in a ring shape so as to surround the cut 22.

The cut 22 is formed in the deepest portion at the center of the recess 21. Preferably, the cut 22 is in the form of a slit having the shape of a minus sign ("–") when viewed from above. Preferably, in an initial state in which no piercing needle is inserted into the cut 22, the cut 22 is closed as shown in FIG. 3, and a liquid- and gas-tight seal is formed. Preferably, when a piercing needle is inserted into the cut 22, opposing edges that form the cut 22 are deformed in conformity with an outer surface of the piercing needle and come into close contact with that outer surface, and a liquid- and gas-tight seal is formed at an interface between the valve element 20 and the piercing needle. Preferably, when the piercing needle is subsequently withdrawn from the valve element 20, the valve element 20 immediately returns to its shape in the initial state, and the cut 22 is sealed. In this manner, the valve element 20 functions as a resealable valve.

The valve element 20 is integrated into the shield main body 10 in such a manner as to block the opening 12 in the top plate 11 of the shield main body 10. Coinjection molding, fitting, and other methods can be used as the method for integrating the valve element 20 into the shield main body 10.

In the case of coinjection molding, for example, a preformed shield main body 10 is placed in a mold, the material for the valve element 20 is injected into the mold, and the valve element 20 can be integrated into the shield main body 10 at the same time as the valve element 20 is molded. In the case where such coinjection molding is performed, it is preferable that a thermoplastic elastomer is used as the material for the valve element 20.

In the case of fitting, the shield main body 10 and the valve element 20 are produced separately, and then the valve element 20 is fitted into the opening 12 of the top plate 11 from below. It is preferable that the inner diameter of the opening 12 and the outer diameter of the valve element 20 are set such that the valve element 20 fitted into the opening 12 is compressed in the radial direction by the top plate 11. This is advantageous in preventing separation of the valve element 20 from the top plate 11 and improving the sealability of the cut 22 in the valve element 20. In the case where fitting is performed, it is also possible that after the valve element 20 is fitted into the opening 12, the top plate 11 and the valve element 20 are fixed to each other with an adhesive.

Attachment of Vial Shield to Vial Bottle

A method for attaching the vial shield 1 to a vial bottle will be described.

Figure 5:
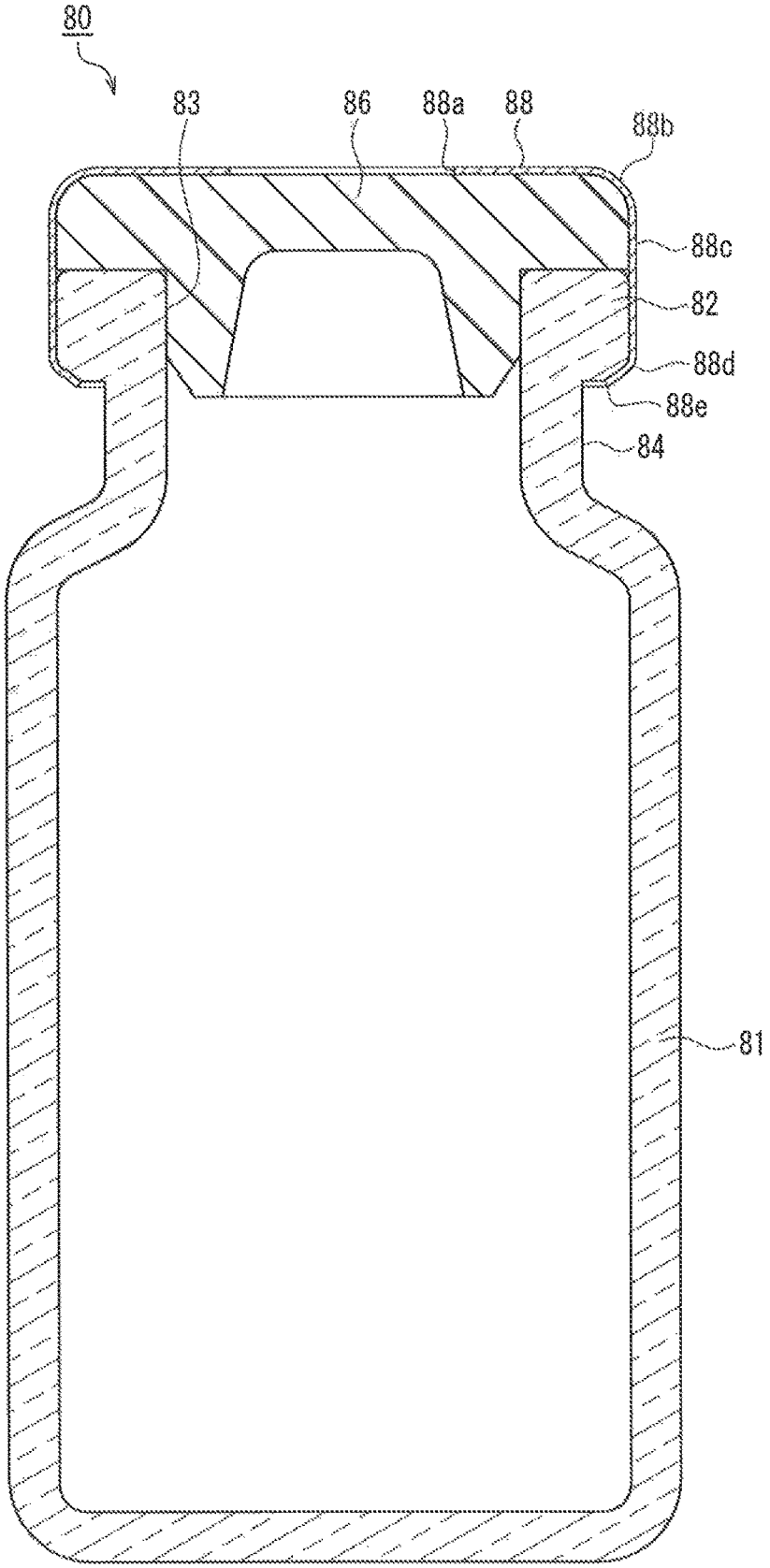
FIG. 5 is a cross-sectional view of an example of a vial bottle to which the vial shield according to Embodiment 1 of the present invention is to be attached.

FIG. 5 is a cross-sectional view of an example of a vial bottle 80 to which the vial shield 1 is attached. The vial bottle 80 is a hermetic container in which a mouth (opening) 83 located at an upper end of a bottle main body 81 and surrounded by a flange 82 is sealed in a gas-tight manner by fitting a stopper (rubber stopper) 86 having substantially the same outer diameter as the flange 82 into the mouth 83. An outer peripheral surface of the flange 82 is a substantially cylindrical surface having a larger outer diameter than a portion (constricted portion) 84 directly under the flange 82. Accordingly, a step is formed between the flange 82 and the constricted portion 84, the step being based on the difference in outer diameter between these two portions.

To prevent dislodgement of the stopper 86 from the mouth 83 of the bottle main body 81, a cap 88 is attached to the stopper 86 and the flange 82. The cap 88 is formed of a sheet made of metal, resin, or the like and is in close contact with the stopper 86 and the flange 82. A lower end 88*e* of the cap 88 is located below the substantially cylindrical outer peripheral surface of the flange 82. An upper end of the cap 88 is located on the upper surface of the stopper 86. A central region of the upper surface of the stopper 86 is exposed to the outside environment via a circular opening 88*a* provided in the cap 88 (see FIG. 6, which will be described later).

Figure 6:
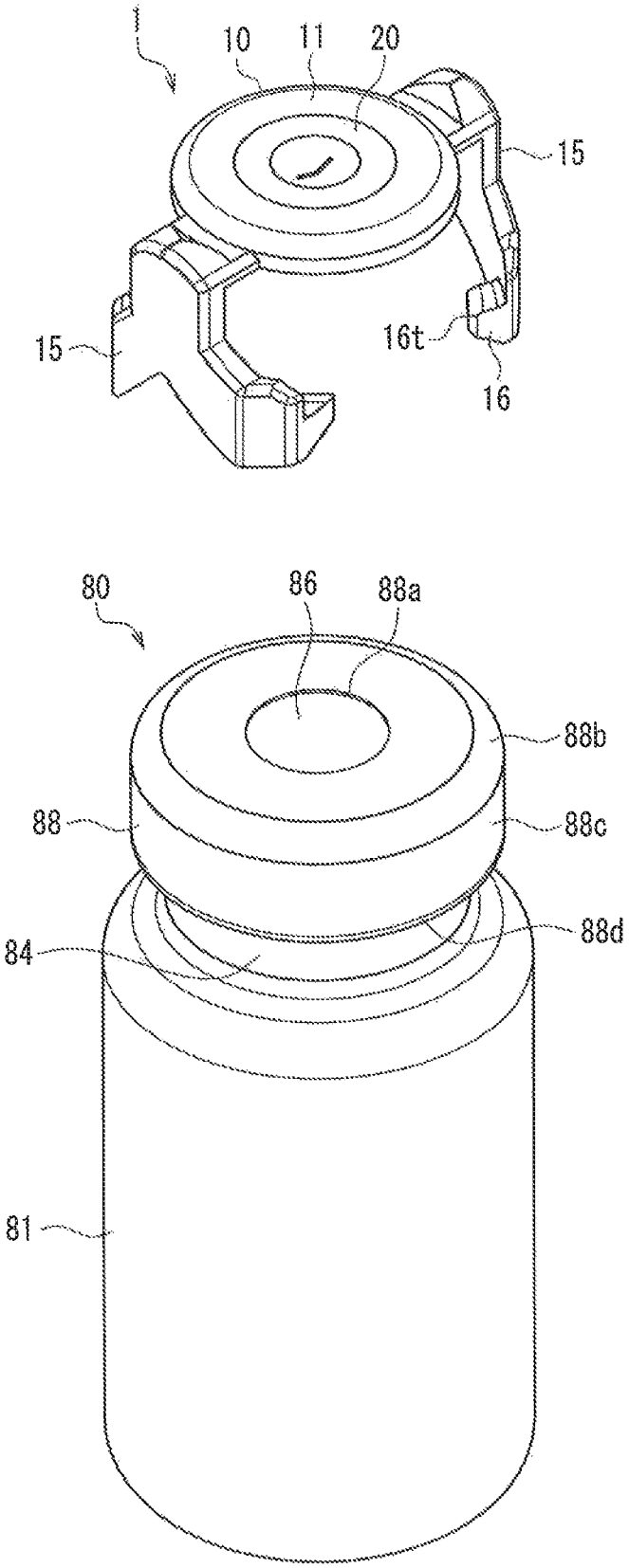
FIG. 6 is a perspective view showing a state immediately before the vial shield according to Embodiment 1 of the present invention is attached to the vial bottle.

As shown in FIG. 6, the vial shield 1 is opposed to the stopper 86 of the vial bottle 80. Then, the cap 88 is fitted between the pair of legs 15 of the vial shield 1, and the vial shield 1 is pressed against the vial bottle 80. The distance between the opposing legs 15 of the vial shield 1 is substantially equal to the outer diameter of the cap 88 of the vial bottle 80. The distance between the leading ends 16*t* of the opposing claws 16 of the vial shield 1 is smaller than the outer diameter of the cap 88. Accordingly, the lower surfaces 16*b* (see FIGS. 1B and 3) of the claws 16 abut an outer peripheral edge 88*b* of an upper surface of the cap 88. The lower surfaces 16*b* of the claws 16 are sloped as described above. Therefore, as the vial shield 1 is further pressed against the vial bottle 80, the pair of legs 15 are elastically displaced in a direction in which the claws 16 move away from the central axis 1*a*. After the leading ends 16*t* of the claws 16 pass the outer peripheral edge 88*b* of the upper surface of the cap 88, the leading ends 16*t* slide on an outer peripheral surface 88*c* of the cap 88. Then, when the leading ends 16*t* of the claws 16 go over a lower edge 88*d* of the outer peripheral surface 88*c* of the cap 88, the pair of legs 15 are elastically restored, and the claws 16 fit into the constricted portion 84.

Figure 7:
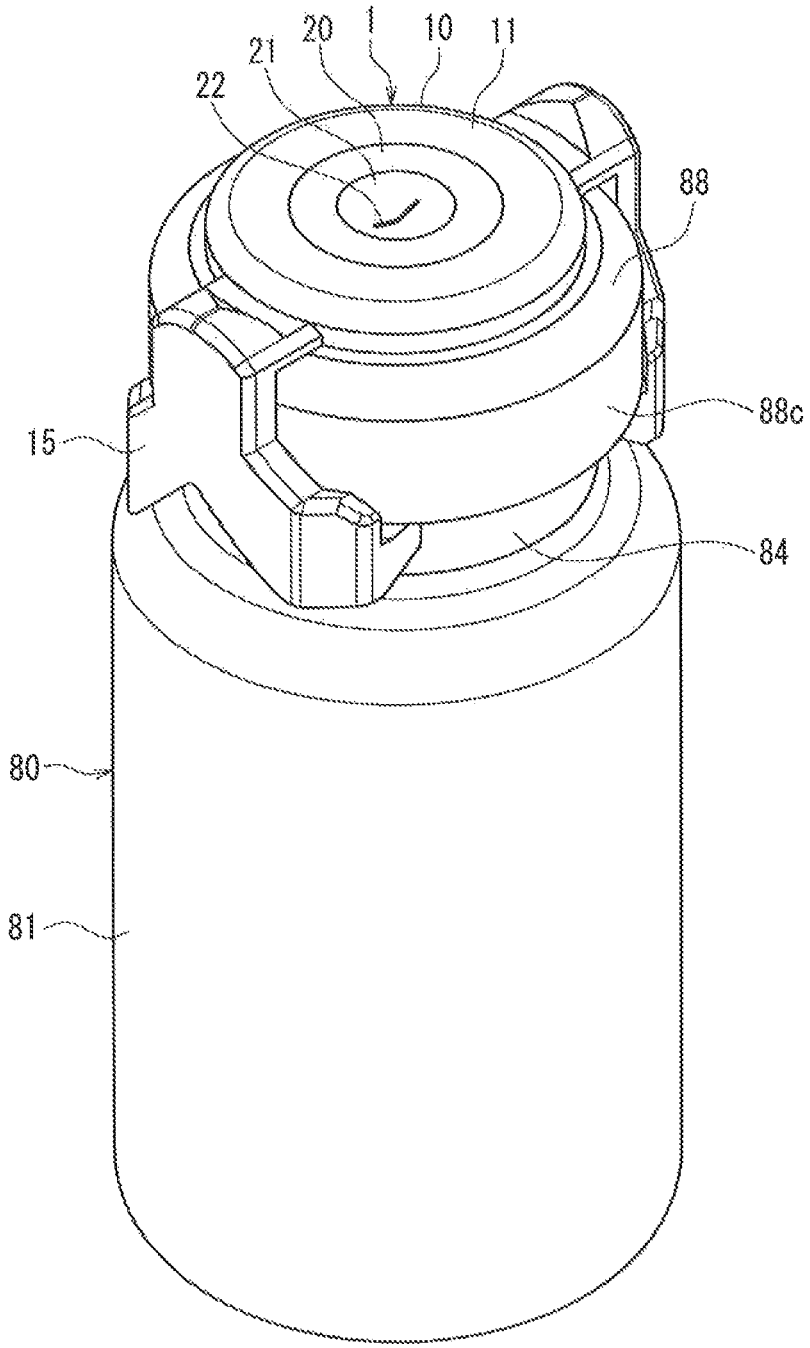
FIG. 7 is a perspective view of the vial shield according to Embodiment 1 of the present invention when attached to the vial bottle.
Figure 8A:
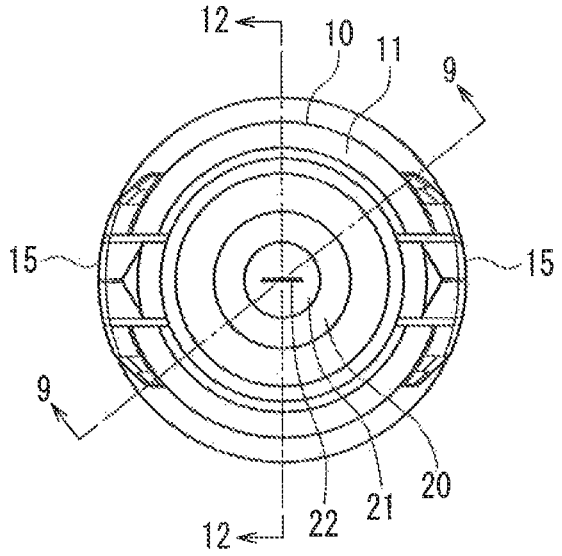
FIG. 8A is a plan view of the vial shield according to Embodiment 1 of the present invention when attached to the vial bottle.
Figure 8B:
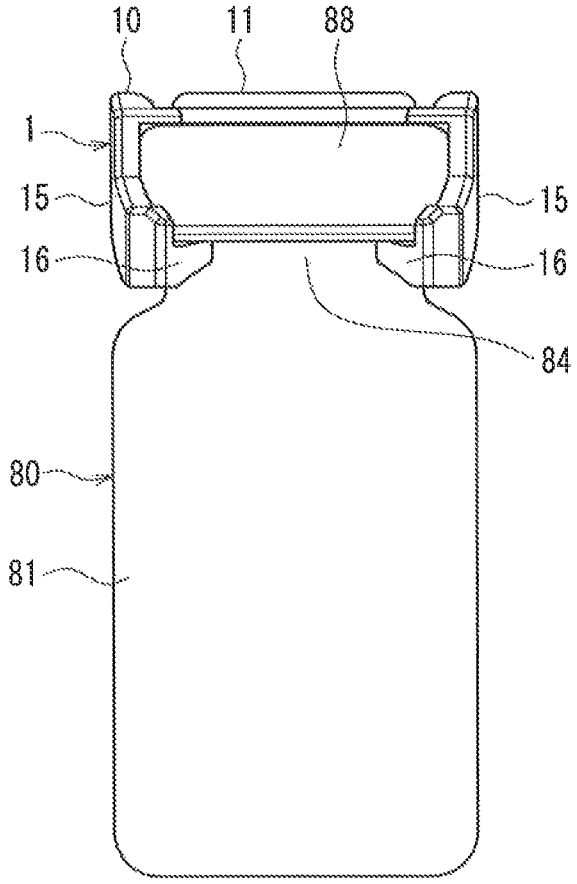
FIG. 8B is a side view of the vial shield according to Embodiment 1 of the present invention when attached to the vial bottle.
Figure 9:
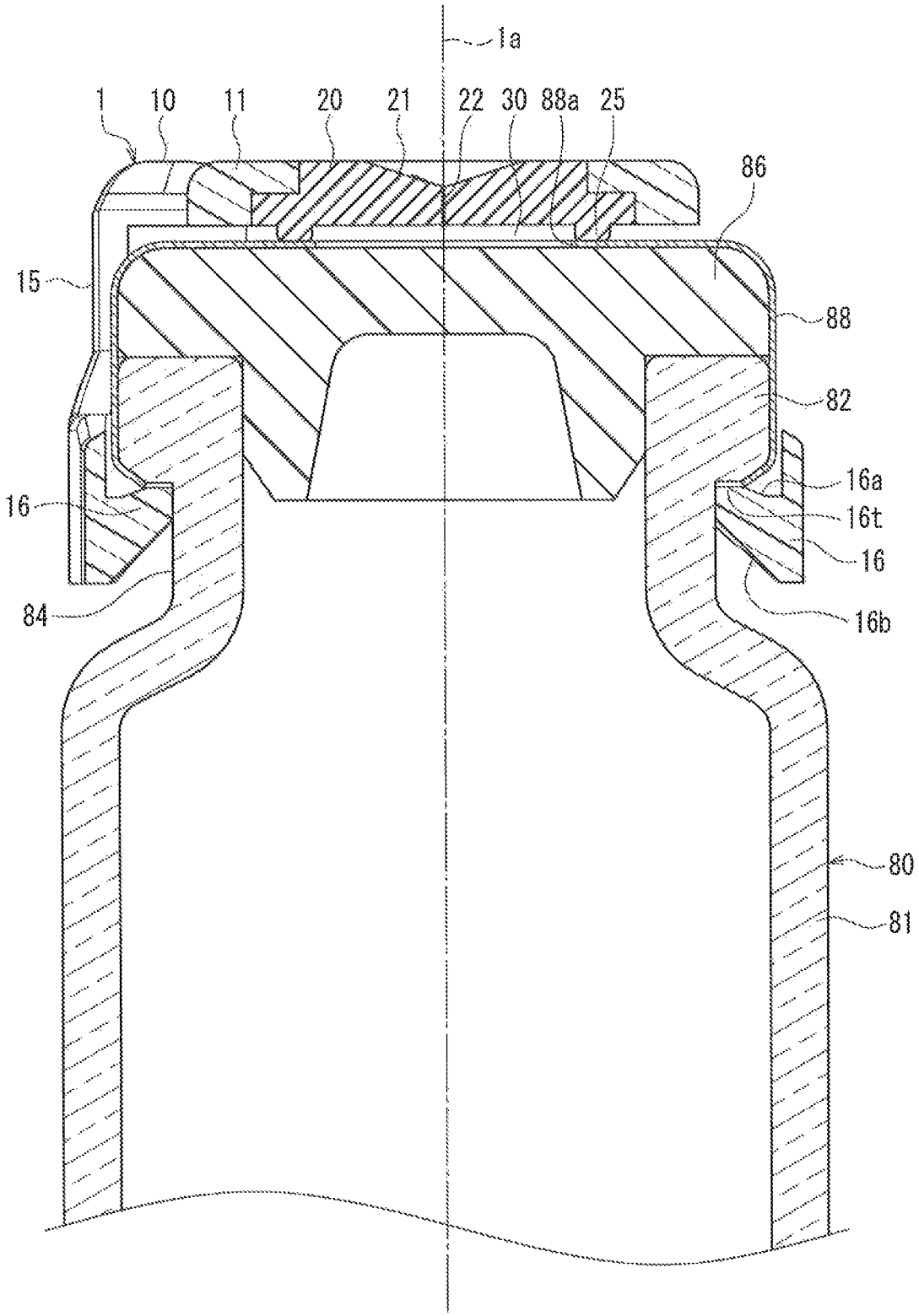
FIG. 9 is a cross-sectional view of the vial shield and the vial bottle taken along a cross-section containing line 9-9 in FIG. 8A.

Thus, as shown in FIG. 7, the vial shield 1 is attached to the vial bottle 80. FIG. 8A is a plan view of the vial shield 1 attached to the vial bottle 80, and FIG. 8B is a side view thereof. FIG. 9 is a cross-sectional view of the vial shield 1 and the vial bottle 80 taken along a cross-section containing line 9-9 in FIG. 8A. The cross-section in FIG. 9 includes the central axis 1*a* of the vial shield 1 and the leading ends 16*t* of the claws 16.

Since the legs 15 are elastically displaceable, and the lower surfaces 16*b* of the claws 16 are sloped, the claws 16 are engaged with the flange 82 by simply pushing the vial shield 1 onto the vial bottle 80 as described above, and thus the vial shield 1 can be attached to the vial bottle 80.

Accordingly, the ease of operation for attaching the vial shield 1 to the vial bottle 80 is favorable.

As shown in FIGS. 7 and 9, the top plate 11 and the valve element 20 of the vial shield 1 covers a portion of the upper surface of the stopper 86. The legs 15 oppose the cylindrical outer peripheral surface 88*c* of the cap 88.

As shown in FIG. 9, the claws 16 provided in the vial shield 1 are engaged with the flange 82 via the cap 88. The annular rib 25 protruding from the lower surface of the valve element 20 abuts against a region of the cap 88 that extends on the upper surface of the stopper 86. Engagement of the claws 16 with the flange 82 causes the rib 25 of the valve element 20 to be pressed against the cap 88 and thus elastically compressively deformed in the vertical direction. Accordingly, a liquid-tightly sealed space 30 is formed between the stopper 86 and the valve element 20.

The rib 25 abuts against the cap 88 on the stopper 86, rather than the stopper 86 that is exposed in the opening 88*a* of the cap 88. This is advantageous in increasing the capacity of the space 30. Also, this is advantageous in improving the sealability of the space 30 because the cap 88 is harder than the stopper 86.

The pair of legs 15 (including the claws 16) hold the vial bottle 80 therebetween in the horizontal direction, and thus the vial shield 1 is positioned relative to the vial bottle 80 in the horizontal direction and fixed thereto. Moreover, the valve element 20 and the claws 16 hold the stopper 86 and the flange 82 therebetween in the vertical direction via the cap 88, and thus the vial shield 1 is positioned relative to the vial bottle 80 in the vertical direction and fixed thereto. Even when an external force or vibration is applied to the vial shield 1, the vial shield 1 does not become unintentionally dislodged from the vial bottle 80.

In the case where the distance between the opposing legs 15 is smaller than the outer diameter of the cap 88, the horizontal portions 15*a* (especially the thin portions 15*c* of the respective horizontal portions 15*a*) are elastically bent, so that the legs 15 are displaced in such a manner as to increase the distance between the legs 15 in accordance with the outer diameter of the cap 88. Moreover, in the case where the distance between the opposing claws 16 is smaller than the outer diameter of the constricted portion 84, the horizontal portions 15*a* (especially the thin portions 15*c* of the respective horizontal portions 15*a*) are elastically bent, so that the legs 15 are displaced in such a manner as to increase the distance between the claws 16 in accordance with the outer diameter of the constricted portion 84. Accordingly, the vial bottle 80 to which the vial shield 1 is attachable can have a wide range of dimensions (especially the outer diameters of the cap 88 and the constricted portion 84).

When the legs 15 are displaced in the above-described manner by the cap 88 and the constricted portion 84 having large diameters, the claws 16 are displaced radially outward, and the attitudes (orientations) thereof are changed. As described above, in the initial state (no-load state) in which the legs 15 are not displaced, the upper surfaces 16*a* (see FIG. 3) of the claws 16 are each sloped such that the side of the leading end 16*t* approaches the top plate 11. For this reason, even when the claws 16 are displaced radially outward, the state in which the leading ends 16*t* are located at higher levels than the respective upper surfaces 16*a* can be maintained. Accordingly, the leading ends 16*t*, or the vicinities thereof, of the respective claws 16 always abut against the flange 82. Thus, even in the case where the cap 88 or the constricted portion 84 has a large outer diameter, reliable engagement of the claws 16 with the flange 82 can be secured.

Connection between Vial Bottle and Piercing Needle

Figure 10:
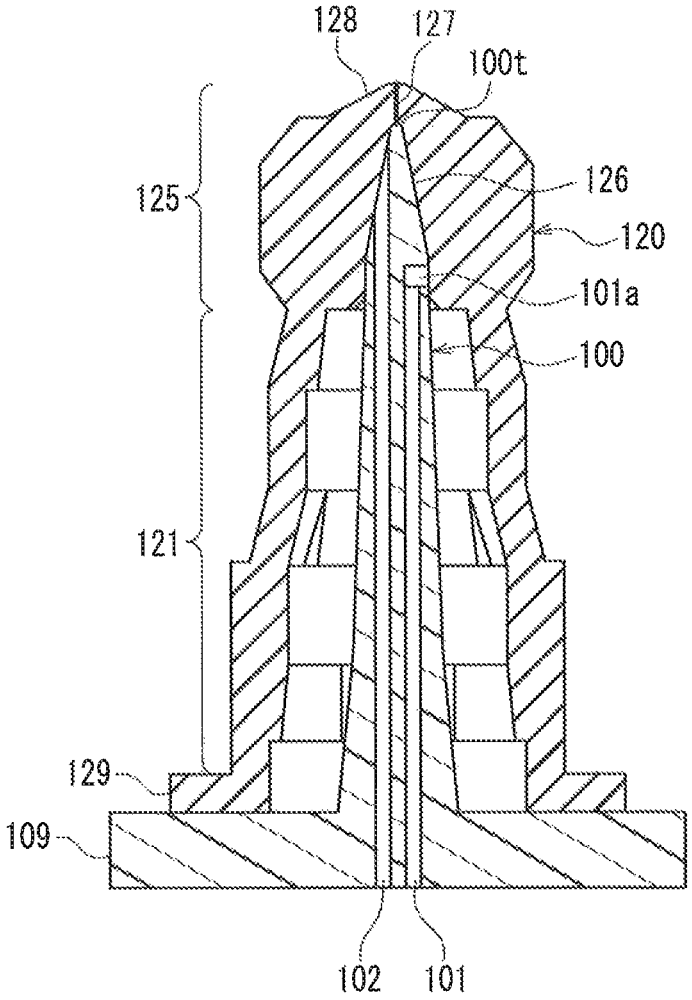
FIG. 10 is a cross-sectional view of an example of a piercing needle with a cover with which the vial bottle is to be pierced.
Figure 11:
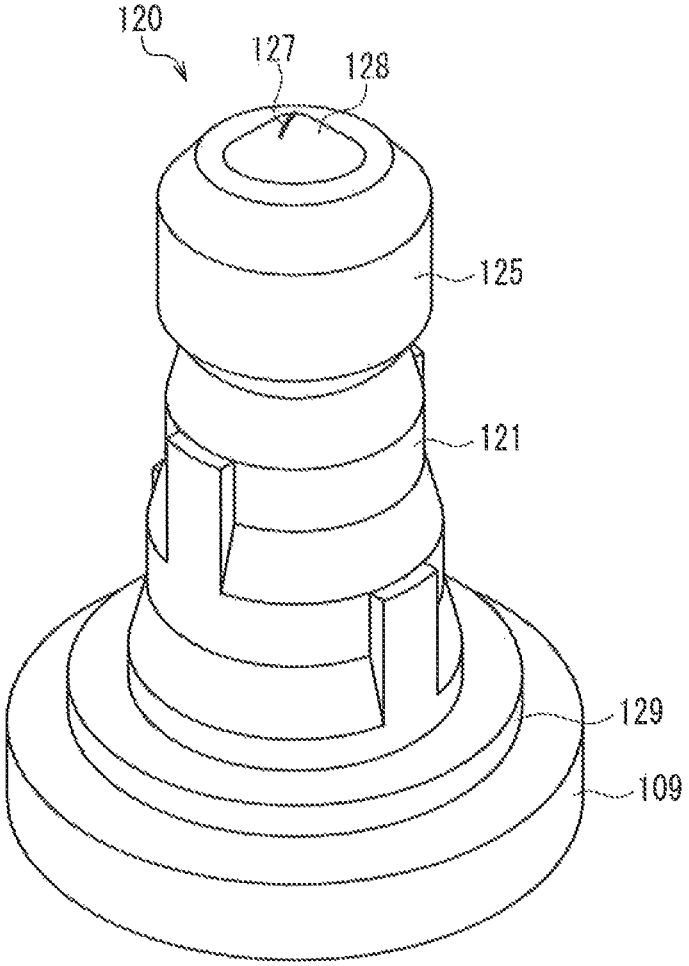
FIG. 11 is a perspective view of the example of a piercing needle with a cover with which the vial bottle is to be pierced.

According to the present invention, after the vial shield 1 is attached to the vial bottle 80 in the above-described manner, the stopper 86 is pierced with the piercing needle via the valve element 20. In the present invention, the piercing needle may have any configuration, and a conventionally known piercing needle can be used, for example. A cover for covering at least a leading end of the piercing needle may also be attached to the piercing needle in order to prevent a drug solution from escaping to the outside environment through the leading end of the piercing needle. FIG. 10 is a cross-sectional view of an example of such a piercing needle 100 with a cover 120, and FIG. 11 is a perspective view thereof.

As shown in FIG. 10, the piercing needle 100 is a rod-shaped member protruding from a base 109 and has a sharp leading end 100*t*. Within the piercing needle 100, two flow passages 101 and 102 are formed independently of each other, extending in a longitudinal direction of the piercing needle 100. The flow passage 101 constitutes a liquid flow passage through which a liquid flows, and the flow passage 102 constitutes a gas flow passage through which a gas flows. The liquid flow passage 101 is in communication with a lateral hole 101*a* on the side of the leading end 100*t*. The lateral hole 101*a* extends in a direction orthogonal to the longitudinal direction of the piercing needle 100 and opens in an outer surface of the piercing needle 100. The gas flow passage 102 opens in a substantially conical surface constituting the outer surface of the piercing needle 100 on the side of the leading end 100*t*.

The base 109 may be, for example, a portion of a connector (not shown) connected to the vial bottle 80. In FIG. 10, the liquid flow passage 101 and the gas flow passage 102 individually open in a lower surface of the base 109; however, it is also possible that these flow passages are individually extended and respectively communicate with desired flow passages. For example, the piercing needle of the connector disclosed in Patent Document 1 or 2 may be used as the piercing needle 100.

Preferably, the piercing needle 100 and the base 109 are made of a hard material that can be regarded as a substantially rigid body. Specifically, the piercing needle 100 and the base 109 can be produced by a method such as integral molding, using a resin material such as polyacetal, polycarbonate, or the like.

The cover 120 includes an outer peripheral wall 121 having a hollow, substantially tubular shape, a head portion 125 provided at one end of the outer peripheral wall 121, and an annular base portion 129 provided at the other end of the outer peripheral wall 121. When a compressive force in the vertical direction is applied to the cover 120, the outer peripheral wall 121 is elastically compressively deformed such that the vertical dimension thereof decreases. The cover 120 can be integrally formed of a flexible (pliable) material (e.g., silicone rubber, isoprene rubber) so as to allow this compressive deformation.

In the head portion 125, an inner cavity 126 is formed into which a portion of the piercing needle 100 that includes the leading end 100*t*, the opening of the gas flow passage 102, and the opening of the lateral hole 101*a* is inserted. An inner surface of the inner cavity 126 is set to have a shape that conforms to the outer surface of the piercing needle 100. In a state in which a portion of the piercing needle 100 that includes the leading end 100*t* is inserted into the inner cavity 126 as shown in FIG. 10, the opening of the lateral hole 101*a* that is in communication with the liquid flow passage 101 is liquid-tightly sealed by the inner surface of the inner cavity 126.

A slit 127 passing through the head portion 125 in the vertical direction is formed at the innermost portion of the inner cavity 126. As shown in FIG. 11, the slit 127 is a straight line-shaped cut having the shape of "–" (minus sign) when viewed from above. Preferably, in an initial state in which the piercing needle 100 does not pass through the slit 127, opposing edges that form the slit 127 are in contact with each other and form a liquid-tight seal.

As shown in FIG. 11, a protruding portion 128 protruding upward is formed at the center of an upper surface of the head portion 125. Although an outer surface of the protruding portion 128 is a substantially conical surface in Embodiment 1, surfaces having other shapes including a substantially truncated conical surface, a convex surface, such as a spherical surface, that smoothly bulges like a dome, and the like may also be adopted. The slit 127 passes through the top (center) of the protruding portion 128.

The base portion 129 is provided to fix the cover 120 to the base 109. The method for fixing the base portion 129 to the base 109 is not particularly limited, and any method such as bonding, fusion bonding, engaging, fitting, and the like can be used.

Now, connection between the vial bottle 80 to which the vial shield 1 of the present invention is attached and the piercing needle 100 will be described.

Figure 12:
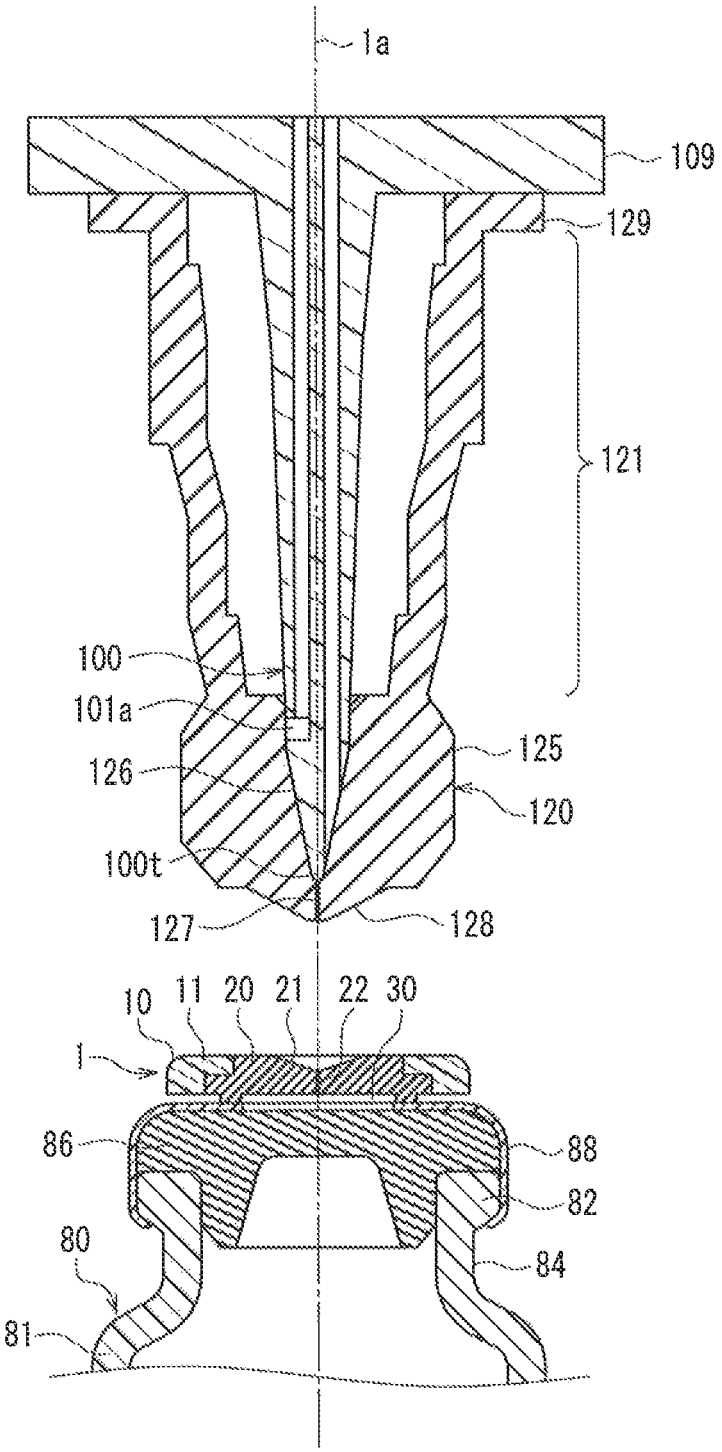
FIG. 12 is a cross-sectional view of the vial bottle equipped with the vial shield according to Embodiment 1 of the present invention and the piercing needle with the cover immediately before the piercing needle is connected to the vial bottle.

FIG. 12 is a cross-sectional view of the vial bottle 80 to which the vial shield 1 is attached and the piercing needle 100 with the cover 120 immediately before being connected to each other. The cross-section in FIG. 12 is a vertical plane containing line 12-12 in FIG. 8A and is orthogonal to the cut 22 that is formed in the valve element 20. As shown in FIG. 12, the head portion 125 of the cover 120 is opposed to the valve element 20 of the vial shield 1 attached to the vial bottle 80. At this time, the leading end 100*t* of the piercing needle 100, which is not visible to an operator, can be correctly aligned with the cut 22 of the valve element 20 by abutting the protruding portion 128 of the head portion 125 against the recess 21 of the valve element 20. Then, the piercing needle 100 is pressed against the vial bottle 80. The leading end 100*t* of the piercing needle 100 passes through the slit 127 of the head portion 125 and protrudes from the protruding portion 128. The leading end 100*t* of the piercing needle 100 is guided by the surface of the recess 21 of the valve element 20 to the cut 22 that is formed at the deepest portion of the recess 21. Then, the leading end 100*t* of the piercing needle 100 passes through the cut 22 of the valve element 20, and furthermore, pierces and passes through the stopper 86. In this process, the cover 120 (especially the outer peripheral wall 121 thereof) is elastically compressively deformed along the central axis 1*a*.

Figure 13:
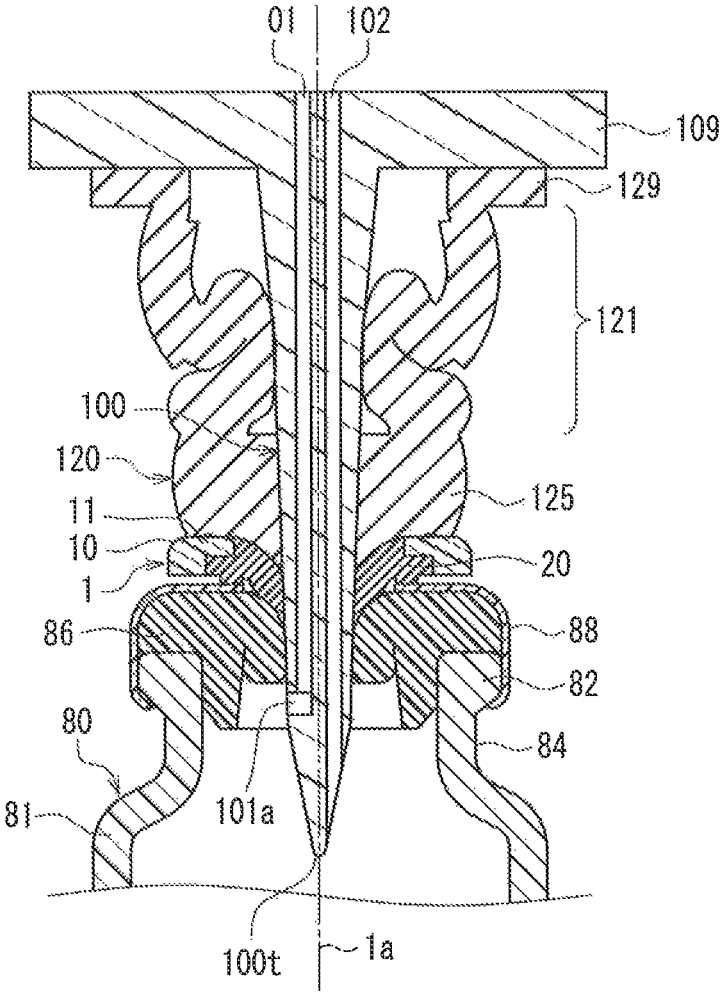
FIG. 13 is a cross-sectional view of the vial bottle equipped with the vial shield according to Embodiment 1 of the present invention and the piercing needle with the cover when the piercing needle is connected to the vial bottle.

FIG. 13 is a cross-sectional view showing a state in which the vial bottle 80 to which the vial shield 1 is attached and the piercing needle 100 with the cover 120 are connected to each other. The cross-section in FIG. 13 is the same as the cross-section in FIG. 12.

As shown in FIG. 13, the piercing needle 100 passes through the slit 127 formed in the head portion 125 of the cover 120, the cut 22 formed in the valve element 20 of the vial shield 1, and furthermore the stopper 86. The valve element 20 and the stopper 86 are significantly deformed toward the bottle main body 81 as a result of being penetrated by the piercing needle 100. The space 30 (see FIG. 12), which had been formed between the valve element 20 and the stopper 86, is crushed and can hardly be visually identified. The cover 120 receives a compressive force from the vial shield 1, and thus the protruding portion 128 (see FIG. 12) of the head portion 125 is significantly deformed to such an extent that its initial shape can no longer be recognized, and is in close contact with the valve element 20, and the outer peripheral wall 121 is significantly compressively deformed.

The lateral hole 101*a* and the gas flow passage 102, which individually open on the side of the leading end 100*t* of the piercing needle 100, are exposed in the vial bottle 80. In this state, it is possible to cause a liquid (e.g., a solvent) to flow into the vial bottle 80 and cause a liquid (e.g., a drug solution obtained by dissolving a drug) within the vial bottle 80 to flow out of the vial bottle 80, via the liquid flow passage 101 and the lateral hole 101*a*. When the liquids flow into and out of the vial bottle 80, air flows into and out of the vial bottle 80 via the gas flow passage 102. This reduces a change in air pressure within the vial bottle 80 and thus facilitates the flowing in and out of the liquids.

After the liquids have flowed into and out of the vial bottle 80 via the piercing needle 100, the piercing needle 100 is withdrawn from the stopper 86.

When the piercing needle 100 is removed from the stopper 86 and the valve element 20, the stopper 86 and the valve element 20 are individually elastically restored to their initial shapes, and the hole that is made in the stopper 86 by the piercing needle 100 is immediately closed, and the cut 22 of the valve element 20 also is immediately closed. After that, when the piercing needle 100 is removed from the slit 127 of the head portion 125 of the cover 120, the slit 127 is immediately elastically restored and closed. The leading end 100*t* and its vicinity of the piercing needle 100 are retracted into the inner cavity 126 of the head portion 125. An inner peripheral surface of the inner cavity 126 is in close contact with the outer surface of the piercing needle 100 and blocks the openings of the lateral hole 101*a* and the gas flow passage 102 on the side of the leading end 100*t*. After that, the protruding portion 128 of the head portion 125 is separated from the valve element 20 and returns to the initial state shown in FIG. 12. The emptied vial bottle 80 is discarded with the vial shield 1 remaining attached thereto.

As described above, the vial shield 1 according to Embodiment 1 is attached to the vial bottle 80 so as to cover at least a portion of the stopper 86 of the vial bottle 80 (see FIG. 7). The piercing needle 100 pierces the stopper 86 after passing through the valve element 20 of the vial shield 1 (see FIGS. 12 and 13). When the piercing needle 100 is inserted into the cut 22 of the valve element 20, the opposing edges of the cut 22 of the valve element 20 come into close contact with the outer surface of the piercing needle 100 while leaving no space therebetween, and form a gas-tight seal with the piercing needle 100. Accordingly, when the piercing needle 100 pierces the stopper 86, even if the drug and its vapor within the vial bottle 80 escapes to the outside of the vial bottle 80 through a minute gap between the piercing needle 100 and the stopper 86 because a positive pressure is created within the vial bottle 80, the valve element 20 and the gas-tight seal between the valve element 20 and the piercing needle 100 prevent the drug and the vapor from diffusing to the outside environment.

Moreover, the cut 22 of the valve element 20 is slit-shaped and therefore has high resealability of being immediately closed once the piercing needle 100 is removed from the cut 22. Accordingly, even if a hole that is made in the stopper 86 by the piercing needle 100 is not immediately closed just after the piercing needle 100 is withdrawn from the state in which the piercing needle 100 passes through the stopper 86

(see FIG. 13), and the drug solution and its vapor within the vial bottle 80 escape to the outside of the vial bottle 80 through that hole, the liquid-tight seal formed by the cut 22 of the valve element 20 prevents the drug solution and its vapor from escaping to the outside environment.

Furthermore, even if a drug solution adheres to the outer surface of the piercing needle 100 that is withdrawn from the stopper 86, this drug solution is scraped off by the opposing edges of the cut 22 of the valve element 20 in the process in which the piercing needle 100 is withdrawn from the valve element 20. The drug solution that has been scraped off is held in the space 30 between the valve element 20 and the stopper 86. Accordingly, no drug solution adheres to a region of the outer surface (surface on the side of the recess 21) of the valve element 20 that is near the cut 22 and a region in the vicinity of the slit 127 of the protruding portion 128 of the cover 120.

As described above, the vial shield 1 according to Embodiment 1 can reduce the possibility that the drug, the drug solution, and their vapor (hereinafter referred to as "drug etc.") within the vial bottle 80 may be escaped to the outside environment during piercing of the stopper 86 of the vial bottle 80 with the piercing needle 100 and withdrawal of the piercing needle 100 from the stopper 86. Accordingly, the vial shield 1 is advantageous in reducing the possibility of exposure of the operator to a hazardous drug etc.

The valve element 20 of the above-described vial shield 1 has the annular rib 25 (see FIGS. 1B and 3) on its surface on the side of the vial bottle 80. This rib 25 has the following effects.

First, the rib 25 further reduces the possibility of the escape of the drug etc. to the outside environment. The rib 25 is easily elastically compressively deformed when a compressive force in the vertical direction is applied thereto, and is therefore advantageous in forming the sealed space 30 (see FIGS. 9 and 12) between the valve element 20 and the stopper 86. Even if the drug etc. escapes into the space 30, the possibility that the drug etc. may pass through a gap between the valve element 20 and the cap 88 (or the stopper 86) and escape to the outside environment is low because the rib 25 seals the space 30. Moreover, the space 30 is reduced as a result of the valve element 20 being deformed toward the stopper 86 in the process in which the piercing needle 100 passes through the cut 22 of the valve element 20 (see FIG. 13). Since the rib 25 seals the space 30 in a gas-tight manner, the pressure within the space 30 is high. Accordingly, when the piercing needle 100 penetrates the stopper 86, the possibility that the drug etc. within the vial bottle 80 may escape to the side of the valve element 20 through the gap between the piercing needle 100 and the stopper 86 is low.

Second, the rib 25 contributes to properly insert the piercing needle 100 into the cut 22 of the valve element 20. As described above, during insertion of the piercing needle 100 into the valve element 20, the valve element 20 receives a pressing force of the piercing needle 100. The rib 25 is formed on the surface of the valve element 20 that is on the side opposite to the piercing needle 100 so as to surround the cut 22. Accordingly, the pressing force of the piercing needle 100 causes the region of the valve element 20 surrounded by the rib 25 to be depressed. The cut 22 is located at the deepest portion at the center of this region, which is deformed into the depressed shape, of the valve element 20. Accordingly, the piercing needle 100 is reliably guided to the cut 22 by the valve element 20, and the possibility that the piercing needle 100 may pierce (erroneously pierce) a portion of the valve element 20 other than the cut 22 is reduced.

Third, the rib 25 facilitates attachment of the vial shield 1 to vial bottles 80 in which the flange 82 and the stopper 86 have varying vertical dimensions. The rib 25 has compressibility, and thus the variations in vertical dimensions of the flange 82 and the stopper 86 are accommodated by the rib 25 changing the amount of compressive deformation. Accordingly, the allowable dimensional range of the vial bottle 80 to which the vial shield 1 can be attached is expanded.

In the foregoing embodiment, the rib 25 abuts against the cap 88 on top of the stopper 86, rather than the stopper 86. This configuration increases the capacity of the space 30 and is thus advantageous in providing the above-described first and second effects. However, the present invention is not limited to this configuration, and it is also possible that the rib 25 abuts against the upper surface of the stopper 86 that is exposed in the opening 88*a* of the cap 88.

In the foregoing embodiment, the rib 25 extends continuously annularly. This configuration improves the sealability of the space 30 and is thus advantageous in providing the above-described first effect. However, the present invention is not limited to this configuration, and, for example, the rib 25 may be divided at one or more positions, or a plurality of protrusions may be discretely provided around the cut 22.

Since the thin portions 15*c* are formed in the respective horizontal portions 15*a*, mainly the thin portions 15*c* are elastically bent in the process in which the vial shield 1 is attached to the vial bottle 80 or when the vial shield 1 is attached to the vial bottle 80 in which the cap 88 or the constricted portion 84 has a large diameter. Accordingly, even though the legs 15 are displaced in such a manner as to increase the diameter, the top plate 11 and the valve element 20 that is held by the top plate 11 are not substantially deformed. This configuration is advantageous in reducing the possibility of separation of the valve element 20 from the top plate 11. Moreover, this configuration is advantageous in securing the sealability of the space 30 between the valve element 20 and the stopper 86 irrespective of the outer diameter of the cap 88 or the constricted portion 84.

The thin portions 15*c* may be omitted. In this case, when the vial shield 1 is attached to the vial bottle 80, and when the cap 88 or the constricted portion 84 has a large outer diameter, the legs 15 and/or the horizontal portions 15*a* are elastically deformed.

In the foregoing embodiment, the thin portions 15*c* are formed in the respective horizontal portions 15*a*. However, as long as the deformation that may occur in a portion of the top plate 11 that holds the valve element 20 when the legs 15 are elastically displaced can be reduced by the formation of the thin portions 15*c*, the positions at which the thin portions 15*c* are formed can be set as desired. For example, thin portions 15*c* may be formed in border portions of the horizontal portions 15*a* with the respective legs 15, in border portions of the horizontal portions 15*a* with the top plate 11, or in the legs 15. Furthermore, a thin portion 15*c* may be formed in the top plate 11 excluding that portion of the top plate 11 that holds the valve element 20.

The shape of the legs 15 provided in the vial shield 1 is not limited to that of the foregoing embodiment and can be set as desired. In the foregoing embodiment, the legs 15 are connected to the top plate 11 via the respective horizontal portions 15*a*; however, for example, in the case where the top plate 11 has an outer dimension that is approximately equal to the outer diameter of the stopper 86, the horizontal portions 15*a* can be omitted. The legs 15 are not necessarily required to be substantially "Y"-shaped as in the foregoing embodiment, and may also have a substantially "T" shape or a shape having no branching, for example. It is also possible that the legs have a cylindrical surface shape extending in the circumferential direction. However, the legs are preferably divided into a plurality of portions in the circumferential direction in the light of securing elastic displacement of the legs. For example, the legs are divided in the circumferential direction such that the legs spaced at least a leg's width apart. The number of legs 15 that are provided in the vial shield 1 is not necessarily limited to two, and may also be three or more. The number of claws 16 that are provided in a single leg 15 is not necessarily limited to two, and may also be one or three or more. However, in order to stably and reliably attach the vial shield 1 to the vial bottle 80 by using the flange 82 of the vial bottle 80, the number of claws 16 that are provided in the vial shield 1 is preferably three or more.

The claws 16 may have any shape. For example, it is also possible that one or both of the upper surface 16*a* and the lower surface 16*b* is not sloped in such a manner as to approach the top plate 11 toward the leading end 16*t* as described above.

There are cases where a lock mechanism having an engagement claw that is engageable with the flange 82 of the vial bottle 80 is integrally provided in the piercing needle 100 so that the piercing needle 100, in the state (see FIG. 13) in which the piercing needle 100 passes through the stopper 86 of the vial bottle 80, is prevented from being unintentionally disconnected from the stopper 86 due to an external force, vibration, or the like. As can be understood from FIG. 7, in a state in which the vial shield 1 of the present embodiment is attached to the vial bottle 80, only a minute portion of the flange 82 (precisely, the cap 88) is covered by the vial shield 1. Accordingly, in the state in which the vial shield 1 is attached to the vial bottle 80, the piercing needle 100 with the above-described lock mechanism can be connected to the vial bottle 80.

Embodiment 2

Configuration of Vial Shield

Figure 14A:
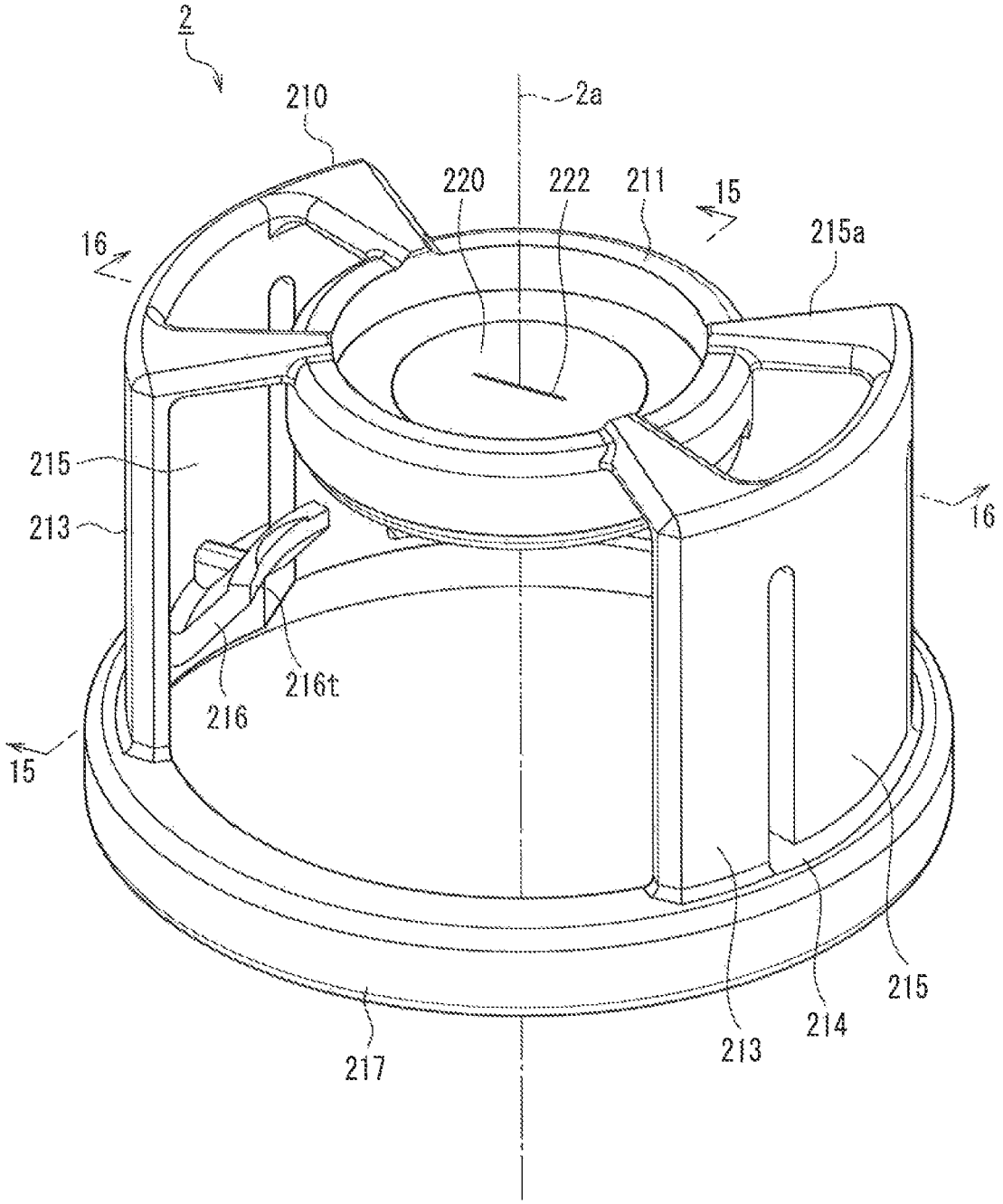
FIG. 14A is a perspective view of a vial shield according to Embodiment 2 of the present invention when viewed from above.
Figure 14B:
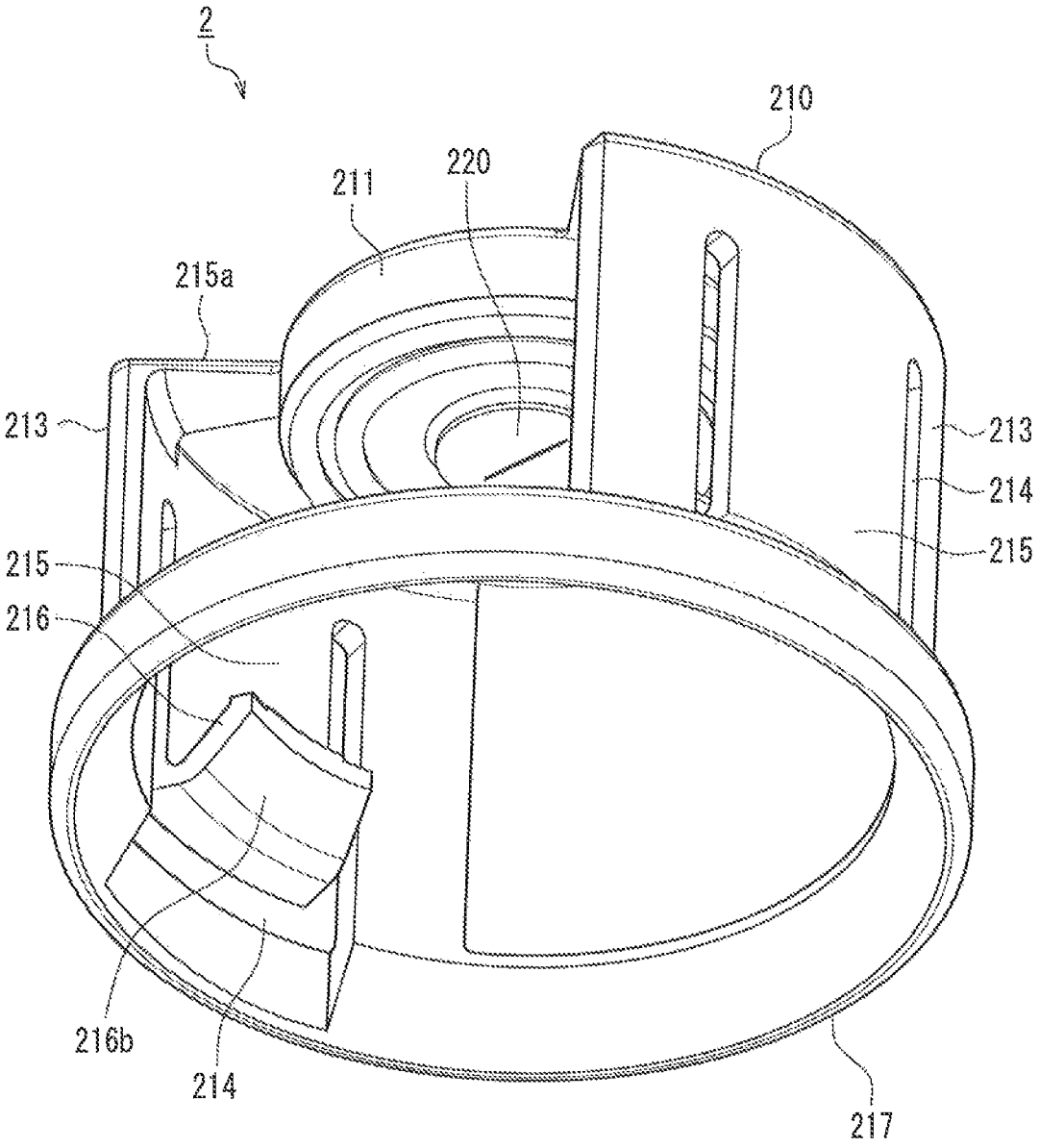
FIG. 14B is a perspective view of the vial shield according to Embodiment 2 of the present invention when viewed from below.
Figure 15:
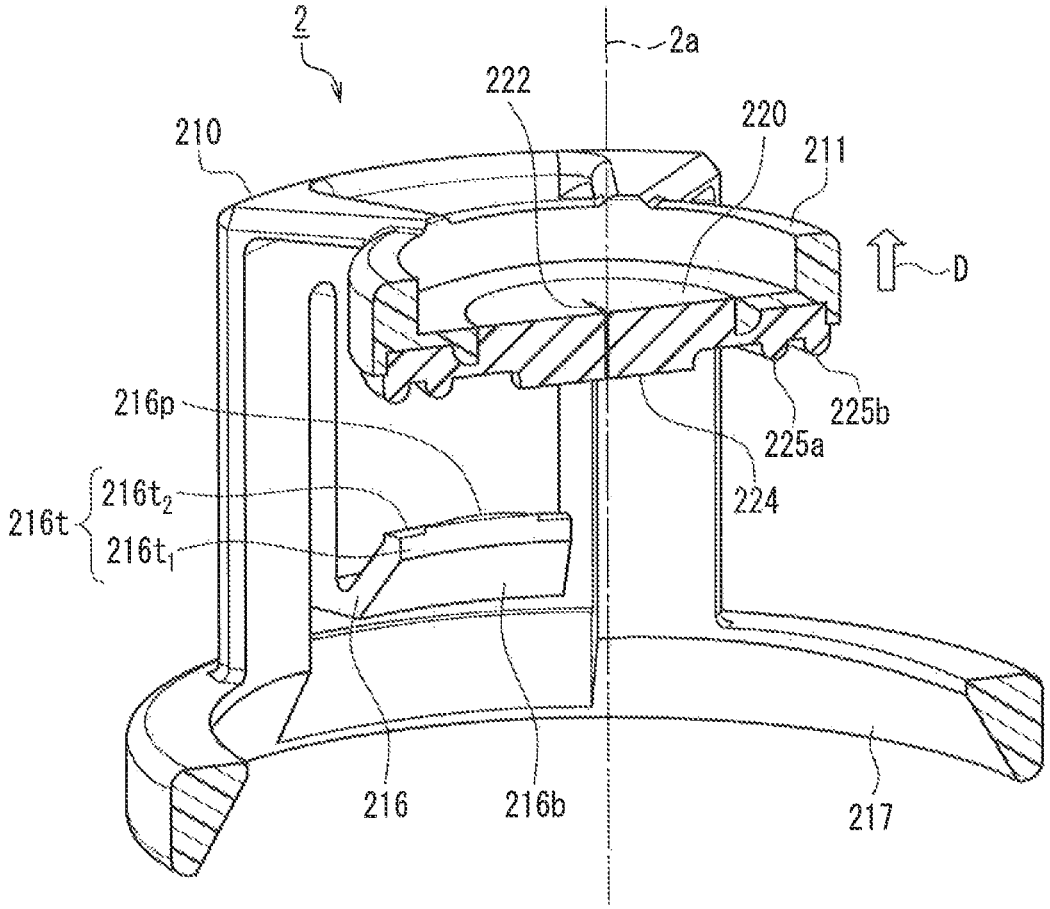
FIG. 15 is a cross-sectional perspective view of the vial shield according to Embodiment 2 of the present invention.
Figure 16A:
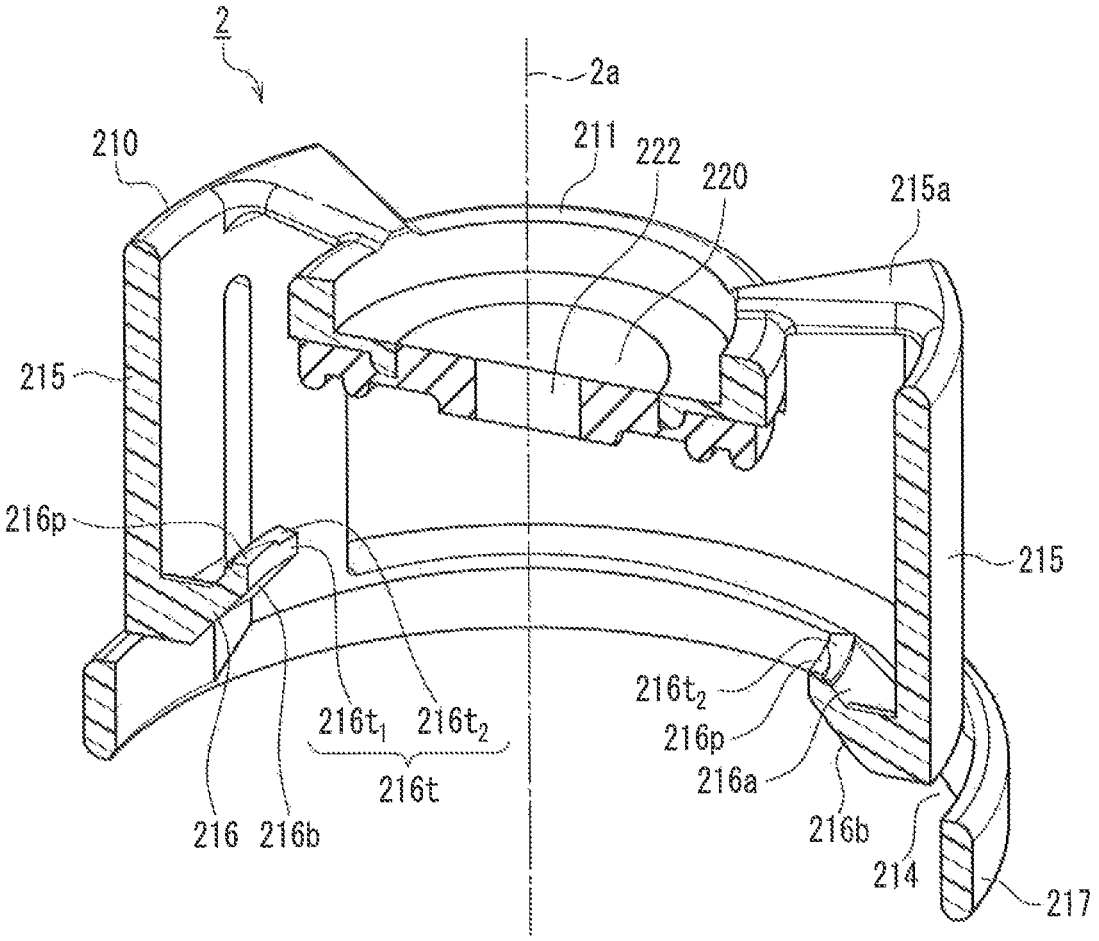
FIG. 16A is a cross-sectional perspective view of the vial shield according to Embodiment 2 of the present invention when viewed from above.
Figure 16B:
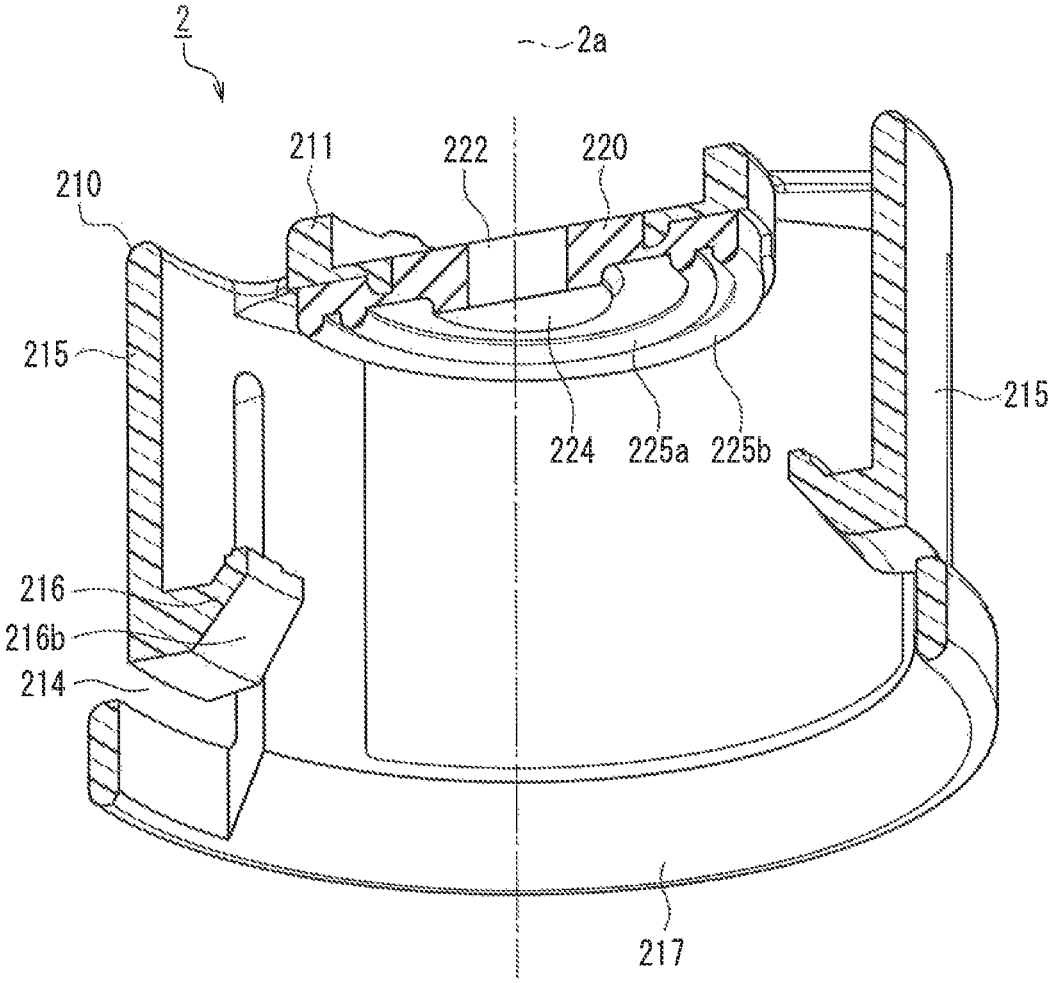
FIG. 16B is a cross-sectional perspective view of the vial shield according to Embodiment 2 of the present invention when viewed from below.
Figure 17:
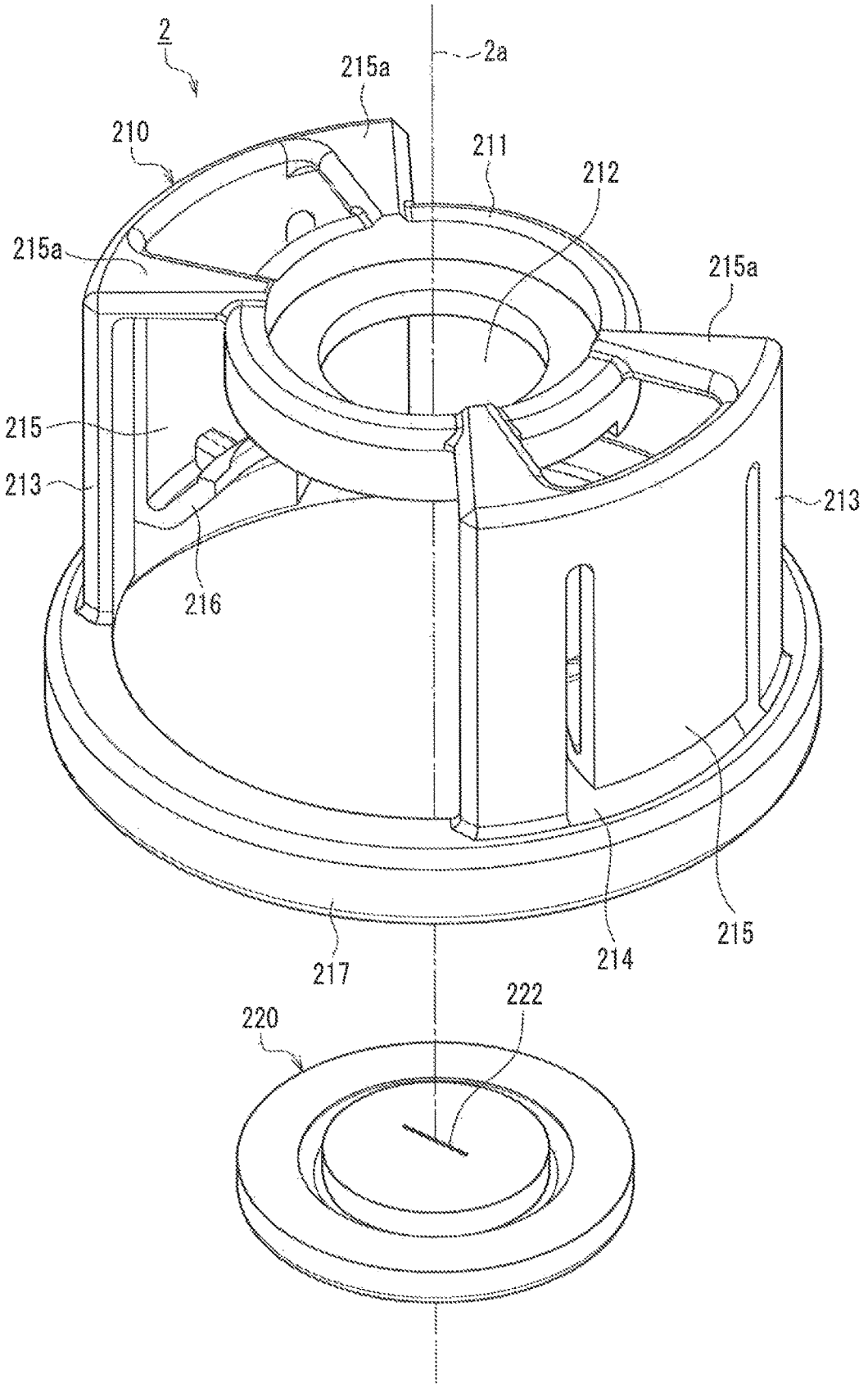
FIG. 17 is an exploded perspective view of the vial shield according to Embodiment 2 of the present invention.

FIG. 14A is a perspective view of a vial shield 2 according to Embodiment 2 of the present invention when viewed from above, and FIG. 14B is a perspective view of the vial shield 2 when viewed from below. FIG. 15 is a cross-sectional perspective view of the vial shield 2 when viewed from above taken along a plane containing a central axis 2*a* of the vial shield 2 and line 15-15 in FIG. 14A. FIG. 16A is a cross-sectional perspective view of the vial shield 2 when viewed from above taken along a plane containing the central axis 2*a* and line 16-16 in FIG. 14A. FIG. 16B is a cross-sectional perspective view of the vial shield 2 when viewed from below taken along the plane containing the central axis 2*a* and line 16-16 in FIG. 14A. FIG. 17 is an exploded perspective view of the vial shield 2. For the sake of convenience of the following description, the "vertical direction", the "upper side", the "lower side", the "horizontal direction", the "circumferential direction", and the "radial direction" are defined in the same manner as in Embodiment 1. Hereinafter, the vial shield 2 of Embodiment 2 will be described focusing on the differences from Embodiment 1.

As shown in FIG. 17, the vial shield 2 is constituted by a shield main body 210 and a valve element 220.

The shield main body 210 includes a top plate 211 with an opening 212 formed at its center, and a pair of legs 215 extending downward from the top plate 211. The pair of legs 215 are formed inside a pair of side walls 213.

Similarly to the top plate 11 of Embodiment 1, the top plate 211 is a ring-shaped object whose outer edge and inner edge have concentric circular shapes in a plan view, the inner edge defining the opening 212. However, the shape of the top plate 211 is not limited to this. For example, the outer edge of the top plate 211 in a plan view may also have any shape such as an elliptic shape, a rhombic shape, or the like.

Two pairs of horizontal portions (bridge portions) 215*a* extend substantially in the radial direction from an outer peripheral edge of the top plate 211. The side walls 213 extend downward substantially parallel to the central axis 2*a* from outer ends (ends on the side opposite to the top plate 211) of the respective pair of horizontal portions 215*a*. The side walls 213 are plate-shaped objects extending along a cylindrical surface that is coaxial with the central axis 2*a*. The pair of side walls 213 are coupled to each other at their lower ends via an annular portion 217 having a circular shape that is coaxial with the central axis 2*a*. The annular portion 217 protrudes outward of the side walls 213 with respect to the radial direction.

Substantially "U"-shaped slits (cuts) 214 are formed in the side walls 213. A portion defined by each slit 214 constitutes the leg 215. The legs 215 each have a cantilevered structure in which an upper end thereof is a fixed end and a lower end thereof is a free end. A claw 216 protruding toward the central axis 2*a* is formed at the lower end (free end) of each leg 215. The legs 215 can be elastically bent such that the respective claws 216 move away from the central axis 2*a*. In contrast, the side walls 213 are supported by the horizontal portions 215*a* at their upper ends and supported by the annular portion 217 at their lower ends, and are thus hardly displaced in the radial direction even if an external force is applied thereto.

As shown in FIGS. 15, 16A, and 16B, both an upper surface (surface that opposes the top plate 211) 216*a* and a lower surface (surface on the side opposite to the top plate 211) 216*b* of each claw 216 are sloped such that the closer to the central axis 2*a*, the closer to the top plate 211. Each claw 216 has, at its leading end 216*t*, a surface (leading end inner surface) $\mathbf{216}t_1$ that opposes the central axis 2*a* and a surface (leading end upper surface) $\mathbf{216}t_2$ that opposes the top plate 211. The leading end inner surface $\mathbf{216}t_1$ is a cylindrical surface that is coaxial with the central axis 2*a*. The leading end upper surface $\mathbf{216}t_2$ is substantially parallel to a horizontal plane. A locking protrusion 216*p* protruding toward the top plate 211 is formed on the leading end upper surface $\mathbf{216}t_2$, extending along an edge of the leading end upper surface 216*t*2 on the side of the central axis 2*a*.

The horizontal portions 215*a* and the side walls 213 (including the legs 215) are arranged at symmetrical positions with respect to the central axis 2*a*.

The vertical dimension and/or the circumferential dimension of the horizontal portions 215*a* is small, and thus the rigidity of the horizontal portions 215*a* is relatively small. Accordingly, when an upward force is exerted on the top plate 211, the horizontal portions 215*a* are inclined in such a manner that their inner ends (ends on the side of the top plate 211) move upward, so that the top plate 211 can be elastically displaced (translated) upward (in the direction indicated by arrow D in FIG. 15).

The shield main body 210 is made of a hard material. Although there is no particular limitation on the material for the shield main body 210, the same resin material as that for the shield main body 10 of Embodiment 1 can be used. Similarly to the shield main body 10, the shield main body 210 can be integrally formed by injection molding the above-described resin material.

As shown in FIG. 17, the valve element 220 is a thin plate-shaped object having a circular shape in a plan view. A cut 222 passing through the valve element 220 in the thickness direction (vertical direction) is formed at the center of the valve element 220. In this example, the recess 21 (see FIG. 3) that is formed in the valve element 20 of Embodiment 1 is not formed in the upper surface of the valve element 220. However, a recess similar to the recess 21 may also be formed in the upper surface of the valve element 220.

As shown in FIG. 16B, a central protrusion 224, a first rib 225*a*, and a second rib 225*b* that protrude downward so as to have a fixed height are formed on the lower surface of the valve element 220. The central protrusion 224 is formed in a circular region at the center of the valve element 220. The cut 222 is formed within the central protrusion 224. Both the first rib 225*a* and the second rib 225*b* extend continuously so as to have ring shapes. The first rib 225*a* is disposed apart from the central protrusion 224 in such a manner as to surround the central protrusion 224. The second rib 225*b* is disposed apart from the first rib 225*a* in such a manner as to surround the first rib 225*a*. The central protrusion 224, the first rib 225*a*, and the second rib 225*b* are arranged coaxially with the central axis 2*a*. Otherwise, the valve element 220 is substantially the same as the valve element 20 of Embodiment 1. The description of the valve element 20 applies to the valve element 220.

Similarly to Embodiment 1, the valve element 220 is integrated into the shield main body 210 in such a manner as to block the opening 212 in the top plate 211 of the shield main body 210.

Attachment of Vial Shield to Vial Bottle

A method for attaching the vial shield 2 to the vial bottle 80 (see FIG. 5) will be described.

Figure 18:
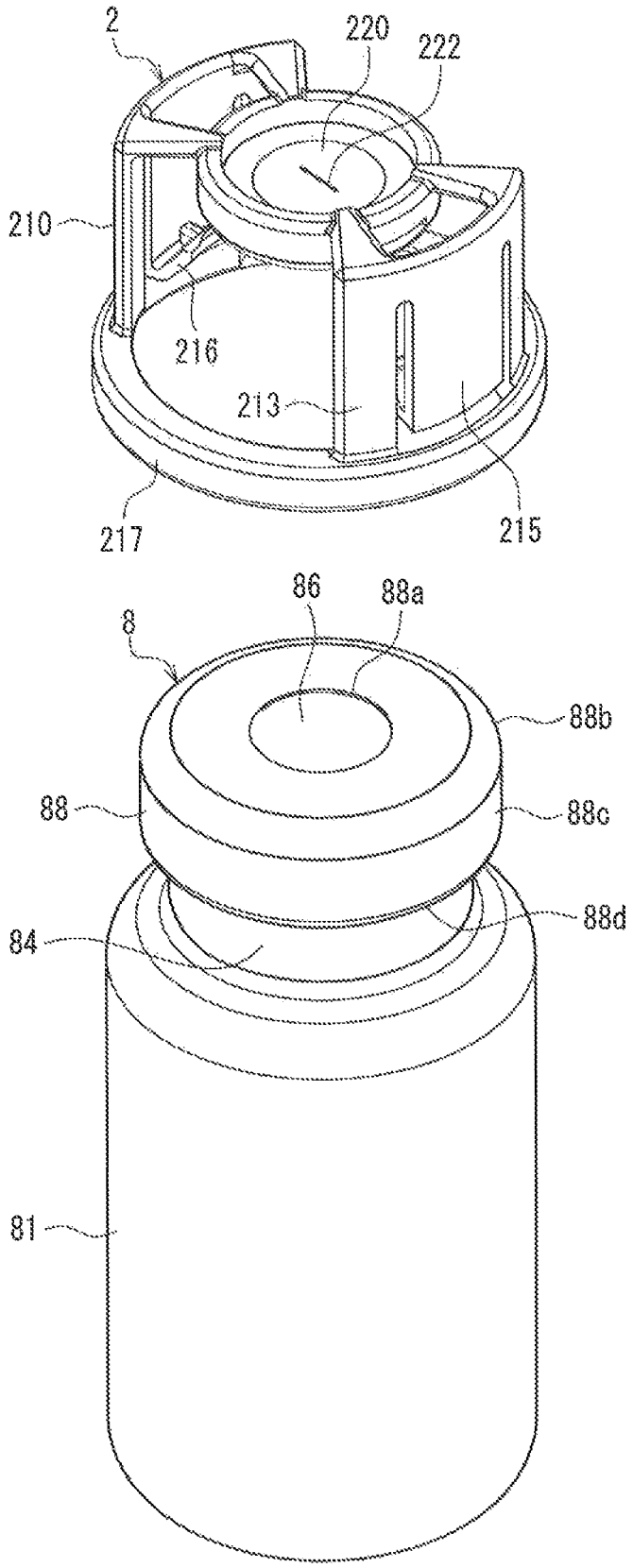
FIG. 18 is a perspective view showing a state immediately before the vial shield according to Embodiment 2 of the present invention is attached to the vial bottle.

As shown in FIG. 18, the vial shield 2 is opposed to the stopper 86 of the vial bottle 80. The cap 88 is inserted into the annular portion 217 of the vial shield 2 and subsequently between the pair of legs 215, and the vial shield 2 is pressed against the vial bottle 80. The distance between the opposing legs 215 of the vial shield 2 is substantially equal to the outer diameter of the cap 88 of the vial bottle 80. The distance between the leading ends 216*t* of the opposing claws 216 of the vial shield 2 is smaller than the outer diameter of the cap 88. Accordingly, the lower surfaces 216*b* (see FIGS. 14B and 16B) of the respective claws 216 abut the outer peripheral edge 88*b* of the upper surface of the cap 88. Since the lower surfaces 216*b* of the respective claws 216 are sloped as described above, the further the vial shield 2 is pressed against the vial bottle 80, the further the pair of legs 215 are elastically deformed in a direction in which the claws 216 move away from the central axis 2*a*. The leading ends 216*t* of the respective claws 216 pass the outer peripheral edge 88*b* of the upper surface of the cap 88, and then slide on the outer peripheral surface 88*c* of the cap 88. Then, when the leading ends 216*t* of the respective claws 216 go over the lower edge 88*d* of the outer peripheral surface 88*c* of the cap 88, the pair of legs 215 are elastically restored, and the claws 216 fit into the constricted portion 84.

Figure 19:
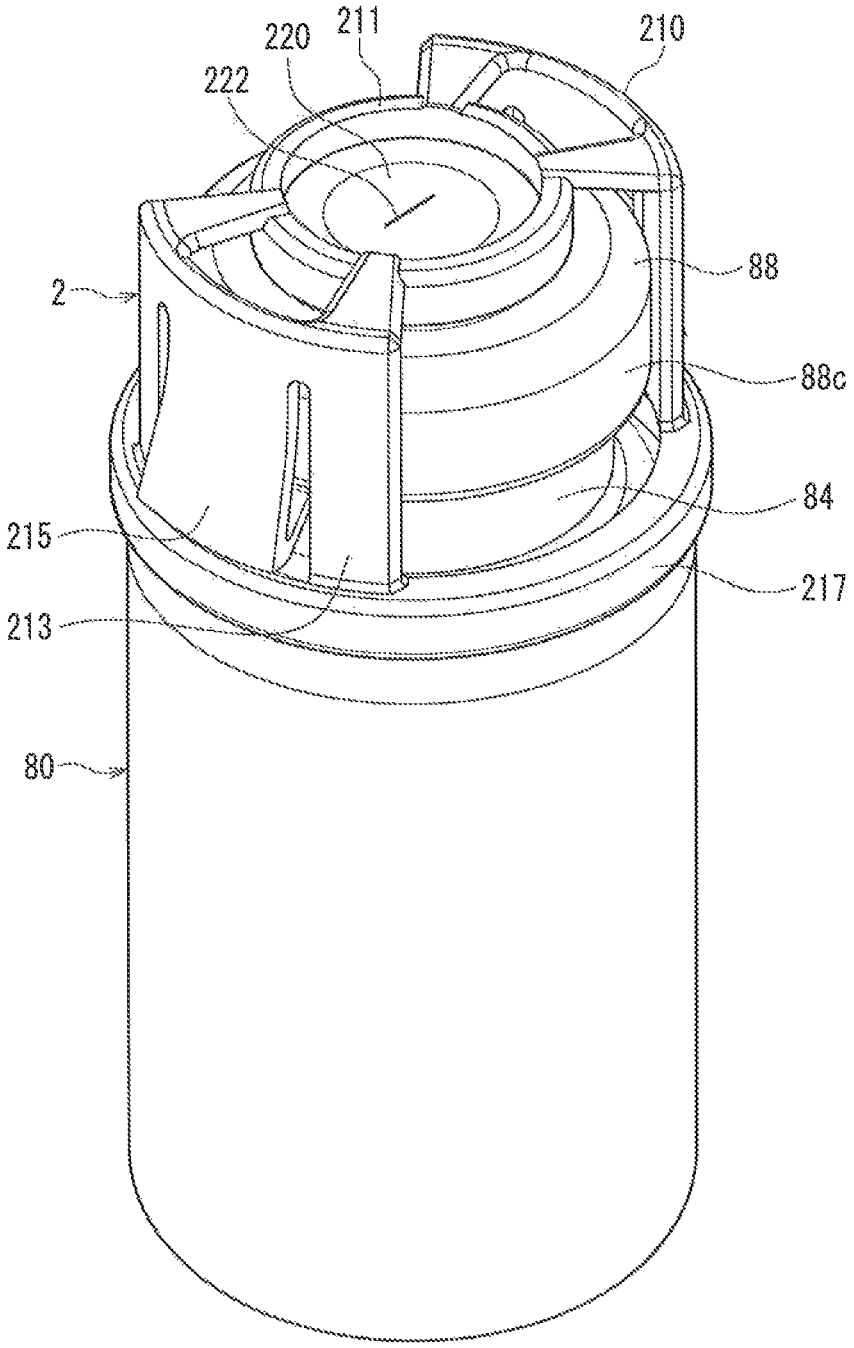
FIG. 19 is a perspective view of the vial shield according to Embodiment 2 of the present invention when attached to the vial bottle.
Figure 20:
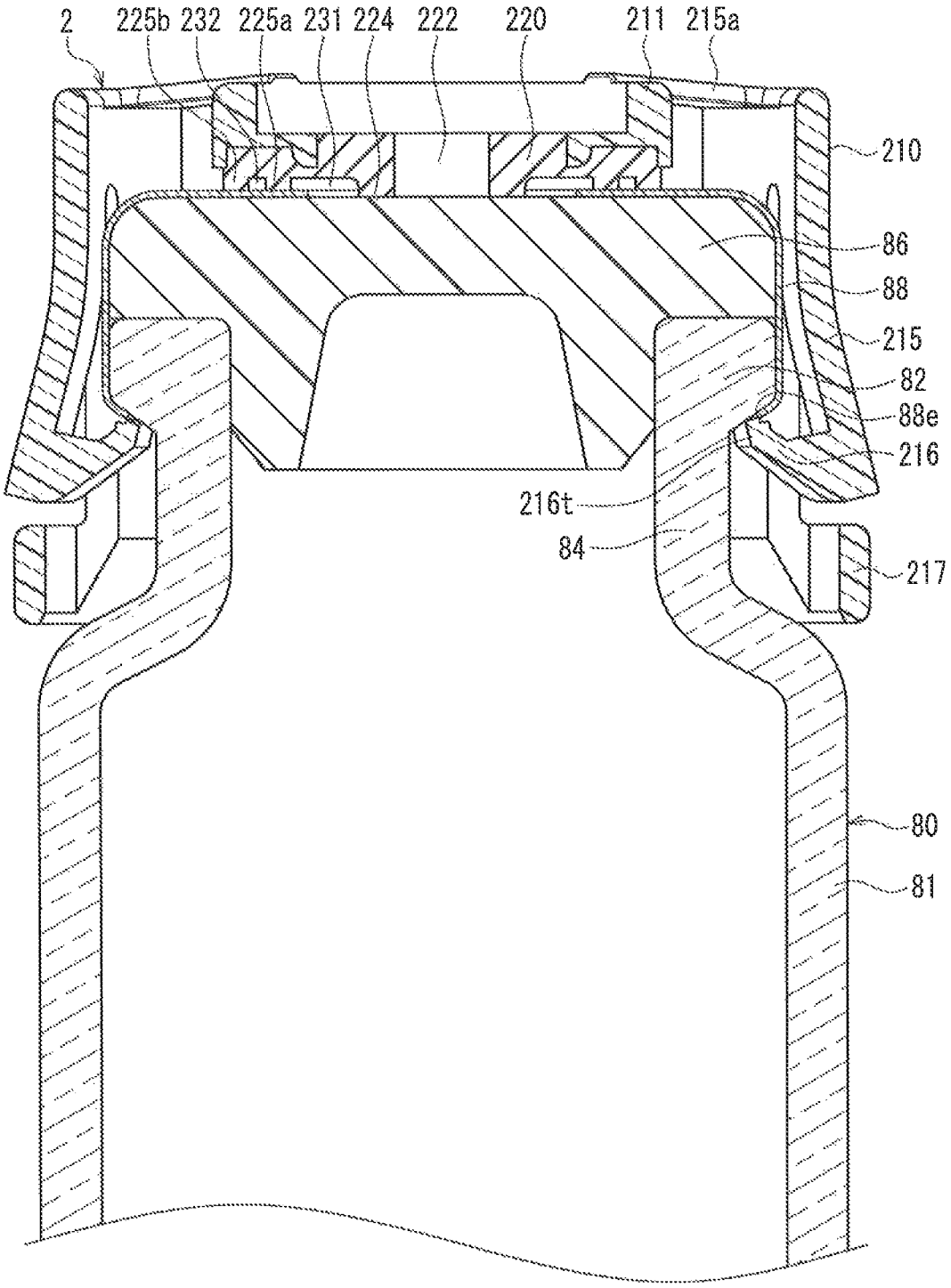
FIG. 20 is a side cross-sectional view of the vial shield according to Embodiment 2 of the present invention when attached to the vial bottle.

Thus, as shown in FIGS. 19 and 20, the vial shield 2 is attached to the vial bottle 80.

Since the legs 215 are elastically deformable, and the lower surfaces 216*b* of the respective claws 216 are sloped, the claws 216 are engaged with the flange 82 by simply pushing the vial shield 2 onto the vial bottle 80 as described above, and thus the vial shield 2 can be attached to vial bottle 80. Accordingly, the ease of operation for attaching the vial shield 2 to the vial bottle 80 is favorable.

As shown in FIG. 19, the top plate 211 and the valve element 220 of the vial shield 2 cover a portion of the upper surface of the stopper 86. The side walls 213 and the legs 215 oppose the cylindrical outer peripheral surface 88*c* of the cap 88.

As shown in FIG. 20, the claws 216 provided in the vial shield 2 engage with the flange 82 via the cap 88. The annular ribs 225*a* and 225*b* protruding from the lower surface of the valve element 220 abut against the cap 88 extending on the upper surface of the stopper 86. Due to the engagement of the claws 216 with the flange 82, the ribs 225*a* and 225*b* of the valve element 220 are pressed against the cap 88 and elastically compressively deformed in the vertical direction. The central protrusion 224 of the valve element 220 abuts against the upper surface of the valve element 86 that is exposed in the opening 88*a* of the cap 88. Accordingly, a first space 231 and a second space 232 that are liquid-tightly sealed are formed between the stopper 86 and the valve element 220. The first space 231 is formed inward of the first rib 225*a*, more specifically, between the central protrusion 224 and the first rib 225*a*. The second space 232 is formed between the first rib 225*a* and the second rib 225*b*.

The ribs 225*a* and 225*b* abut against the cap 88 on the stopper 86, rather than the stopper 86 exposed in the opening 88*a* of the cap 88. This is advantageous in increasing the capacity of the first space 231. Also, this is advantageous in improving the sealability of the first space 231 and the second space 232 because the cap 88 is harder than the stopper 86.

The pair of legs 215 (including the claws 216) hold the vial bottle 80 therebetween in the horizontal direction, and thus the vial shield 2 is positioned relative to the vial bottle 80 in the horizontal direction and fixed thereto. Moreover, the valve element 220 and the claws 216 hold the stopper 86 and the flange 82 therebetween in the vertical direction via the cap 88, and thus the vial shield 2 is positioned relative to the vial bottle 80 in the vertical direction and fixed thereto. Accordingly, even when an external force or vibration is applied to the vial shield 2, the vial shield 2 is not unintentionally dislodged from the vial bottle 80.

The locking protrusions 216*p* (see FIG. 16A) of the respective claws 216 preferably engage with the lower end 88*e* (see FIG. 5) of the cap 88 on the lower surface of the flange 82 of the vial bottle 80. This configuration is advantageous in more securely attaching the vial shield 2 to the vial bottle 80.

However, the locking protrusions 216*p* can be omitted. In this case, it is possible to engage the leading ends 216*t* of the respective claws 216 with the lower end 88*e* of the cap 88 by reducing the radial dimensions of the leading end upper surfaces 216*t*2 (see FIG. 16A) of the respective claws 216. Accordingly, the same effects as those of the locking protrusions 216*p* can be obtained.

As shown in FIG. 20, in the case where the distance between the opposing claws 216 is smaller than the outer diameter of the constricted portion 84, the legs 215 are elastically bent in such a manner as to increase the distance between the claws 216 in accordance with the outer diameter of the constricted portion 84. Also, in the case where the distance between the opposing legs 215 is smaller than the outer diameter of the cap 88, the legs 215 can be elastically bent in such a manner as to increase the distance between the legs 215 in accordance with the outer diameter of the cap 88. Accordingly, the vial bottle 80 to which the vial shield 2 is attachable can have a wide range of radial dimensions (especially the outer diameters of the cap 88 and the constricted portion 84).

When the legs 215 are deformed as described above by the cap 88 or the constricted portion 84 having a large diameter, the claws 216 are displaced radially outward, and the attitudes (orientations) thereof are changed. As described above, in the initial state (no-load state) in which the legs 215 are not deformed, the upper surfaces 216*a* (see FIG. 16A) of the claws 216 are each sloped in such a manner as to approach the top plate 211 toward the leading end 216*t*. Furthermore, the leading ends 216*t* (especially the locking protrusions 216*p*) of the claws 216 are engageable with the lower end 88*e* of the cap 88. Accordingly, even in the case where the cap 88 or the constricted portion 84 has a large outer diameter, reliable engagement of the claws 216 with the flange 82 can be secured.

The top plate 211 is connected to the legs 215 via the horizontal portions 215*a* so that the top plate 211 can be displaced upward (in the direction indicated by arrow D in FIG. 15) relative to the legs 215. Thus, in the case where the vial shield 2 is attached to a vial bottle 80 in which the vertical dimension of the cap 88 that covers the stopper 86 and the flange 82 is larger than the vertical distance from the valve element 220 to the claws 216, the slope of the horizontal portions 215*a* is elastically changed in accordance with the vertical dimension of the cap 88, and thus the distance from the valve element 220 to the claws 216 is increased. Accordingly, the vial bottle 80 to which the vial shield 2 is attachable can have a wide range of vertical dimensions (especially the vertical dimension of the cap 88).

The ribs 225*a* and 225*b* and the central protrusion 224 have compressibility in the vertical direction. Thus, the ribs 225*a* and 225*b* and the central protrusion 224 are compressively deformed in accordance with the vertical dimensions of the flange 82 and the stopper 86. Accordingly, similarly to the rib 25 of Embodiment 1, the ribs 225*a* and 225*b* and the central protrusion 224 are advantageous in expanding the range of vertical dimensions (especially the vertical dimension of the cap 88) of the vial bottle 80 to which the vial shield 2 can be attached.

Connection between Vial Bottle and Piercing Needle

Similarly to Embodiment 1, in Embodiment 2 as well, after the vial shield 2 is attached to the vial bottle 80 in the above-described manner, the stopper 86 is pierced with the piercing needle via the valve element 220. The piercing needle may have any configuration, and may be, for example, the piercing needle 100 with the cover 120 (FIGS. 10 and 11) described in Embodiment 1.

The vial bottle 80 to which the vial shield 2 is attached and the piercing needle 100 can be connected and disconnected in the same manner as in Embodiment 1 (FIGS. 12 and 13).

Similarly to Embodiment 1, in Embodiment 2 as well, when the piercing needle 100 is inserted into the cut 222 of the valve element 220, the opposing edges of the cut 222 of the valve element 220 come into close contact with the outer surface of the piercing needle 100 while leaving no space therebetween, and form a gas-tight seal with the piercing needle 100. Accordingly, even if the positive pressure within the vial bottle 80 causes a drug and its vapor within the vial bottle 80 to escape to the outside of the vial bottle 80 through a minute gap between the piercing needle 100 and the stopper 86 when the stopper 86 is pierced with the piercing needle 100, the valve element 220 and the gas-tight seal between the valve element 220 and the piercing needle 100 prevent the drug and its vapor from diffusing to the outside environment. The drug and its vapor escaping to the outside of the vial bottle 80 are held in the first space 231 between the valve element 220 and the stopper 86.

In the process in which the piercing needle 100 is withdrawn from the stopper 86, the drug solution adhering to the outer surface of the piercing needle 100 is scraped off by the opposing edges of the cut 222 of the valve element 220. The drug solution that has been scraped off is held in the first space 231 between the valve element 220 and the stopper 86.

Once the piercing needle 100 is removed from the cut 222, the cut 222 is immediately closed. Accordingly, even if a hole that is made in the stopper 86 by the piercing needle 100 is not immediately closed just after the withdrawal of the piercing needle 100 from the stopper 86, and thus the drug solution and its vapor within the vial bottle 80 escape to the outside of the vial bottle 80 through that hole, the liquid-tight seal that is formed by the cut 222 of the valve element 220 prevents the drug solution and the vapor from escaping to the outside environment. The drug solution and its vapor escaping to the outside of the vial bottle 80 are held in the first space 231 between the valve element 220 and the stopper 86.

As described above, similarly to the vial shield 1 of Embodiment 1, the vial shield 2 can reduce the possibility that the drug, the drug solution, and their vapor (drug etc.) within the vial bottle 80 may escape to the outside environment during piercing of the stopper 86 of the vial bottle 80 with the piercing needle 100 and withdrawal of the piercing needle 100 from the stopper 86. Accordingly, the vial shield 2 is advantageous in reducing the possibility of exposure of the operator to a hazardous drug.

Similarly to the rib 25 of Embodiment 1, the annular ribs 225*a* and 225*b* that are formed on the surface of the valve element 220 that is located on the side of the vial bottle 80 further reduce the possibility of the escape of the drug etc. to the outside environment. The ribs 225*a* and 225*b* are elastically compressively deformed when a compressive force in the vertical direction is applied thereto, and form a gas- and liquid-tight seal with the cap 88. The first space 231 and the second space 232 that are formed by the ribs 225*a* and 225*b* function as sealed spaces that keep the drug etc. inside so as to prevent an escape thereof to the outside environment. Even if the drug etc. escapes into the first space 231, the drug etc. needs to sequentially pass between the first rib 225*a* and the cap 88 and between the second rib 225*b* and the cap 88 to escape to the outside environment. In Embodiment 2, double ribs, that is, the ribs 225*a* and 225*b* are arranged, and thus the possibility that the drug etc. may pass between the valve element 220 and the cap 88 (or the stopper 86) and escape to the outside environment is further reduced. It should be noted that the number of annular ribs that are provided in the valve element 220 is not limited to two, and may be one or may be three or more.

The first rib 225*a* on the inner side abuts against the cap 88 on the stopper 86, rather than the stopper 86. Thus, the capacity of the first space 231 is increased, so that a larger amount of drug can be kept in the first space 231. Moreover, since the first rib 225*a* abuts against the relatively hard cap 88, the sealability of the first space 231 is improved. These configurations are advantageous in reducing the possibility of the escape of the drug etc. to the outside environment. However, the present invention is not limited to these configurations, and the first rib 225*a*, and furthermore the second rib 225*b*, may abut against the upper surface of the stopper 86 that is exposed in the opening 88*a* of the cap 88.

In the above-described embodiment, the ribs 225*a* and 225*b* extend continuously annularly. This configuration improves the sealability of the spaces 231 and 232 and is thus advantageous in reducing the possibility of the escape of the drug etc. to the outside environment. However, the present invention is not limited to this configuration, and, for example, the ribs 225*a* and 225*b* may be individually divided at one or more positions, or a plurality of protrusions may be discretely provided around the cut 222.

The effects of the central protrusion 224 of the valve element 220 will be described.

In the process in which a drug in powder form within the vial bottle 80 is dissolved to obtain a drug solution, piercing of the stopper 86 with the piercing needle 100 and withdrawal of the piercing needle 100 from the stopper 86 may be performed a plurality of times. For example, a case is considered in which after the withdrawal of the piercing needle 100 from the stopper 86, the drug etc. escapes into the sealed space between the stopper 86 and the valve element 220. If the valve element 220 is not provided with the central protrusion 224, when an attempt to subsequently insert the piercing needle 100 into the cut 222 of the valve element 220 is made, the pressing force of the piercing needle 100 causes a central portion of the valve element 220 to be displaced toward the stopper 86. Thus, the aforementioned space is compressed, resulting in an increase in the pressure within the space, so that the drug etc. kept in the space may pass through the cut 222 and the boundaries between the cap 88 and the ribs 225*a* and 225*b* and escape to the outside environment.

In contrast, if the valve element 220 is provided with the central protrusion 224, the central protrusion 224 suppresses the deformation of the valve element 220 when an attempt to insert the piercing needle 100 into the cut 222 of the valve element 220 is made. As a result, the possibility that an escape of the drug etc. within the first space 231 to the outside environment may be caused by the compression of the first space 231 is low.

When the piercing needle 100 is inserted into the cut 222 of the valve element 220 and is further passed through the stopper 86, the central protrusion 224 is pressed against and comes into close contact with the stopper 86. Thus, the central protrusion 224 suppresses the escape of the drug etc. within the vial bottle 80 to the side of the valve element 220 through the gap between the piercing needle 100 and the stopper 86. Accordingly, the possibility of the escape of the drug etc. to the outside environment is reduced even more.

The cut 222 is formed within the central protrusion 224. Providing the central protrusion 224 increases the thickness of the opposing edges of the cut 222, resulting in an improvement in the strength thereof. Thus, when the piercing needle 100 is inserted into the cut 222, the sealability between the outer surface of the piercing needle 100 and the opposing edges of the cut 222 is improved. Moreover, after the removal of the piercing needle 100 from the cut 222, the cut 222 can be immediately closed, and thus the resealability of the cut 222 is improved. For these reasons, the possibility of the escape of the drug etc. to the outside environment is reduced even more.

As described above, providing the central protrusion 224 in the valve element 220 is advantageous in reducing the possibility of the escape of the drug etc. to the outside environment.

The lower end (free end) of each leg 215, at which the claw 216 is formed, is surrounded by the side plate 213 and the annular portion 217 via the slit 214. The side plate 213 and the annular portion 217 are more difficult to be displaced than the leg 215. Accordingly, when compared with Embodiment 1, in Embodiment 2, it is difficult for the operator to displace the legs 215 radially outward and release the engagement of the claws 216 with the flange 82 (or the cap 88) by putting the fingers on the lower ends of the respective legs 215. That is to say, once the vial shield 2 is attached to the vial bottle 80, the subsequent detachment of the vial shield 2 from the vial bottle 80 is difficult. Therefore, the possibility that an erroneous operation of releasing the drug etc. that is kept in the spaces 231 and 232 to the outside environment may be performed by erroneously detaching the vial shield 2 from the vial bottle 80 is low. The configuration in which the annular protrusion 217 protrudes radially outward makes it difficult for the operator to put the fingers on the lower ends of the respective legs 215, and is thus advantageous in preventing the aforementioned erroneous operation.

The side plates 213 are discontinuous in the circumferential direction. Thus, as shown in FIG. 19, in a state in which the vial shield 2 is attached to the vial bottle 80, a large portion of the flange 82 (precisely the cap 88) is exposed to the outside environment without being covered by the vial shield 2. Accordingly, as described in Embodiment 1, in a state in which the vial shield 2 is attached to the vial bottle 80, the engagement claw of the lock mechanism that is integrally provided in the piercing needle can be engaged with the flange 82.

In Embodiment 2 above, one leg 215 is connected to the top plate 211 via two horizontal portions 215*a*; however, the number of horizontal portions 215*a* that are provided between one leg 215 and the top plate 211 is not limited to two, and may be one or may be three or more.

The number of claws 216 that are provided in one leg 215 is not necessarily limited to one, and may be two or more.

The number of legs 215 that are provided in the vial shield 2 is not necessarily limited to two, and may be three or more. The number of side plates 213 can be changed as appropriate in accordance with the number of legs 215. However, a side plate having the shape of a single cylinder continuously extending in the circumferential direction may also be adopted. In this case, the numbers of horizontal portions 215*a* and legs 215 and the positions thereof can be set as desired.

The horizontal portions (bridge portions) 215*a* are not necessarily required to extend along a horizontal plane (plane that is orthogonal to the central axis 2*a*). For example, in a no-load state in which the vial shield 2 is not attached to the vial bottle 80, the horizontal portions 215*a* may also be sloped downward toward their inner ends (ends on the side of the top plate 211).

It should be understood that Embodiments 1 and 2 above are for illustrative purposes only. The present invention is not limited to the foregoing embodiments and can be appropriately changed.

It is possible to configure a vial shield of the present invention by appropriately combining the configuration of the vial shield 1 according to Embodiment 1 with the configuration of the vial shield 2 according to Embodiment 2. For example, a vial shield can be configured by combining the shield main body 10 of Embodiment 1 with the valve element 220 of Embodiment 2. Conversely, a vial shield can be configured by combining the shield main body 210 of Embodiment 2 with the valve element 20 of Embodiment 1. The claws 216 of Embodiment 2 may be applied to the claws of the vial shield 1 of Embodiment 1. The claws 16 of Embodiment 1 may be applied to the claws of the vial shield 2 of Embodiment 2.

It is also possible that the claws 16 and 216 are elastically deformable such that the leading ends 16*t* and 216*t* of the claws 16 and 216 are displaced radially outward and/or downward. In this case, the amount of displacement of the legs 15 and 215 can be made small or reduced to zero.

In Embodiments 1 and 2, the annular rib (protrusion) 25 or 225*a* is formed in the valve element 20 or 220, thereby the sealed space 30 or 231 is formed between the stopper 86 and the valve element 20 or 220 and in the region that contains the cut 22 or 222 of the valve element 20 or 220. However, in the present invention, the valve elements 20 and 220 are not necessarily required to include a rib (protrusion) protruding toward the stopper 86. For example, if the lower surface of the valve element 20 or 220 is brought into close contact with the cap 88, a sealed space having a vertical dimension corresponding to the thickness of the cap 88 can be formed between the valve element 20 or 220 and the stopper 86. Providing the valve elements 20 and 220 with a rib (protrusion) as in Embodiments 1 and 2 is advantageous in improving the sealability of the sealed space and increasing the capacity of the sealed space.

The configuration of the piercing needle that passes through the valve element 20 or 220 of the vial shield 1 or 2 is not limited to that described in Embodiments 1 and 2. The vial shield of the present invention is applicable to any piercing needle with which the stopper 86 of the vial bottle 80 can be pierced. The piercing needle is not necessarily required to have the cover 120.

INDUSTRIAL APPLICABILITY

While there is no particular limitation on the field of use of the present invention, the present invention can be preferably used as a vial shield to be attached to a vial bottle storing a hazardous drug such as an anticancer agent. It goes without saying that the present invention can also be used for a vial bottle containing a relatively less hazardous drug.

LIST OF REFERENCE NUMERALS

1, 2 Vial shield
1*a*, 2*a* Central axis of vial shield
10, 210 Shield main body
11, 211 Top plate
12, 212 Opening of top plate
213 Side wall
214 Slit
15, 215 Leg
15*a*, 215*a* Bridge portion (horizontal portion)
15*c* Thin portion
16, 216 Claw
16*a*, 216*a* Surface (upper surface) of claw that opposes top plate
16*t*, 216*t* Leading end of claw
216*p* Locking protrusion
20, 220 Valve element
21 Recess
22, 222 Cut
224 Central protrusion
25, 225*a*, 225*b* Rib (protrusion)
30, 231, 232 Sealed space
80 Vial bottle
81 Bottle main body
82 Flange
83 Mouth
86 Stopper
88 Cap
88*e* Lower end of cap

The invention claimed is:

1. A vial shield configured to attach to a vial bottle so as to cover at least a portion of a stopper that seals a mouth of the vial bottle, the vial shield comprising:
a shield main body including an annular top plate that is laid on top of an upper surface of the stopper;
a plurality of legs extending downward from the top plate;
a plurality of claws provided with the plurality of legs, the plurality of claws configured to engage with a flange that surrounds the mouth of the vial bottle; and
a valve element that blocks an opening at the center of the top plate, wherein a cut passing through the valve element in a vertical direction is formed in the valve element,
wherein the plurality of legs cover only a part of the flange with a remaining part of the flange exposed to an outside environment when the vial shield is mounted on the flange, the legs are spaced at least a leg's width apart, and
the vial shield is configured so that after the vial shield is attached to the vial bottle, a piercing needle can successively pierce the valve element and the stopper.

2. The vial shield according to claim 1,
wherein the top plate is connected to the plurality of legs via a plurality of bridge portions so that the top plate can be displaced upward relative to the plurality of legs.

3. The vial shield according to claim 1,
wherein at least one protrusion is formed on a surface of the valve element that is located on a side opposing the stopper.

4. The vial shield according to claim 3,
wherein the at least one protrusion includes a rib extending continuously annularly so as to surround the cut.

5. The vial shield according to claim 3,
wherein a cap is attached to the stopper and the mouth so as to prevent the stopper from coming off the mouth of the vial bottle, and
the at least one protrusion is provided at a position where the protrusion abuts against the cap.

6. The vial shield according to claim 3,
wherein the at least one protrusion includes a central protrusion, and
the cut is formed within the central protrusion.

7. The vial shield according to claim 6,
wherein the central protrusion is provided at a position where the central protrusion abuts against the stopper.

8. The vial shield according to claim 1,
wherein when the vial shield is attached to the vial bottle, a sealed space is formed between the valve element and the stopper and in a region that contains the cut of the valve element.

9. The vial shield according to claim 1,
wherein a recess is formed in a surface of the valve element that is located on a side opposite to the stopper, and
the cut is formed within the recess.

10. The vial shield according to claim 1,
wherein each of the plurality of claws has, on a side opposing the top plate, a surface that is sloped in such a manner as to approach the top plate toward a leading end of the claw.

11. The vial shield according to claim 1,
wherein a cap is attached to the stopper and the mouth so as to prevent the stopper from coming off the mouth of the vial bottle, and
the plurality of claws are configured to engage with a lower end of the cap.

12. The vial shield according to claim 1, further comprising:

a substantially undisplaceable member that surrounds, via a slit, a portion of the leg in which the claw is formed.

13. The vial shield according to claim 1, wherein a thin portion is provided in the plurality of bridge portions that connect the top plate to the plurality of legs, the plurality of legs, or the top plate, and the thin portion is configured to reduce deformation of a portion of the top plate that holds the valve element, when the plurality of legs are elastically displaced.

14. The vial shield according to claim 1, wherein the number of the plurality of claws is three or more.

15. The vial shield according to claim 1, wherein the shield main body and the valve element are formed separately, an inner diameter of the opening of the top plate of the shield body and an outer diameter of the valve element are set such that the valve element disposed in the opening is compressed in a radial direction by the top plate to form the vial shield, and the valve element is pressed against the vial bottle and elastically compressively deformed in a vertical direction when the vial shield is attached to the vial bottle.

* * * * *